US008998744B1

(12) United States Patent
Castaldo

(10) Patent No.: US 8,998,744 B1
(45) Date of Patent: Apr. 7, 2015

(54) ERGONOMIC HANDLE GOLF CLUB

(71) Applicant: Raymond L. Castaldo, Springfield, IL (US)

(72) Inventor: Raymond L. Castaldo, Springfield, IL (US)

( * ) Notice: Subject to any disclaimer, the term of this patent is extended or adjusted under 35 U.S.C. 154(b) by 0 days.

(21) Appl. No.: 13/975,368

(22) Filed: Aug. 26, 2013

(51) Int. Cl.
*A63B 53/16* (2006.01)
*A63B 53/14* (2006.01)
*A63B 59/00* (2006.01)

(52) U.S. Cl.
CPC ..... *A63B 53/14* (2013.01); *A63B 59/004* (2013.01); *A63B 59/0055* (2013.01); *A63B 53/16* (2013.01); *A63B 59/0025* (2013.01)

(58) Field of Classification Search
CPC ..... A63B 59/004; A63B 53/16; A63B 53/14; A63B 59/0025; A63B 59/0055; A63B 59/0051
USPC ..... 473/294, 295, 296, 298, 299, 204, 473/300–303, 314
See application file for complete search history.

(56) References Cited

U.S. PATENT DOCUMENTS

| | | | | |
|---|---|---|---|---|
| 3,245,686 | A | 4/1966 | Hartmeister | |
| 3,533,630 | A | 10/1970 | LoMonaco | |
| 5,037,103 | A * | 8/1991 | Williams et al. | 473/294 |
| 5,377,984 | A | 1/1995 | Ciccia | |
| 5,388,834 | A * | 2/1995 | Dawson | 473/211 |
| 5,595,385 | A | 1/1997 | Jablonski | |
| 5,976,030 | A | 11/1999 | Hsieh | |
| 6,343,997 | B1 | 2/2002 | Allen | |
| 7,544,135 | B1 * | 6/2009 | Higgins | 473/294 |
| 7,658,683 | B1 * | 2/2010 | Daniel | 473/294 |
| 7,708,651 | B2 | 5/2010 | Shin | |
| 7,997,997 | B2 | 8/2011 | Bennett | |
| 8,002,644 | B2 | 8/2011 | Hocknell | |
| 8,012,037 | B2 | 9/2011 | Evans | |
| 8,105,179 | B1 | 1/2012 | Allen | |
| 8,246,483 | B2 | 8/2012 | Garno | |
| 2002/0066163 | A1 | 6/2002 | Lomax | |
| 2003/0114240 | A1 * | 6/2003 | Lacoste | 473/294 |

(Continued)

FOREIGN PATENT DOCUMENTS

| | | | |
|---|---|---|---|
| AU | 100092 | A4 | 5/2008 |
| CN | 101461999 | A | 6/2009 |

(Continued)

OTHER PUBLICATIONS

William S. Marrus and Wildemar Karwowski (editors), Anatomic vs. Physiologic Wrist Neutral Zone, Fundamentals and Assessment Tools for Occupational Ergonomics, the Occupational Ergonomics Handbook, Second Edition, p. 39-2, published 2006 CRC Press, Taylor and Francis Group.

(Continued)

*Primary Examiner* — Benjamin Layno

(57) ABSTRACT

One embodiment of a golf club of the type having a shaft (30) with a head (32) on one end and a base (24) on the other end. A proximal handle (20) and a distal handle (22) each extend from the base. The orientation of the proximal handle and distal handle are each set at an angle relative to the axis of the base. Each handle is directed outward from the shaft in a respective meridian which is substantially opposite the head. The proximal handle is grasped with the preferred hand for substantial control and power of the swing. The distal handle is grasped with the non-preferred hand to augment the control and power of any desired portion of the swing. Other embodiments are described as shown.

18 Claims, 17 Drawing Sheets

(56) References Cited

U.S. PATENT DOCUMENTS

| | | | |
|---|---|---|---|
| 2010/0120560 | A1 | 5/2010 | Clancy |
| 2011/0014990 | A1 | 1/2011 | Malcolm |

FOREIGN PATENT DOCUMENTS

| | | | |
|---|---|---|---|
| GB | 2480090 | A | 9/2011 |
| JP | 247658 | A | 10/2009 |
| KR | 0086285 | A | 8/2009 |

OTHER PUBLICATIONS

Range of Motion Evaluation Chart, Washington State Department of Social and Health Services, p. 2, http://www.dshs.wa.gov/pdf/ms/forms/13_585a.pdf.

Tour Angle 144, Medallion Fulfillment and Logistics, 20675 Nordhoff street, Chatsworth, California, 91313, http://www.tourangle144.com.

Easy Ergonomics: A guide to Selecting Non-Powered Hand tools, The California Department of Industrial Relations and the National Institute for Occupational Safety and Health, 2004, Publications Dissemination, National Institute for Occupational Safety and Health, Department of Health and Human Services, Centers for Disease Control and Prevention, http://www.dir.ca.gov/dosh/dosh_publications/handtools.html.

Equipment Permitted Conditionally for Medical Reasons, p. 1 and 2, United States Golf Association, http://www.usga.org/equipment/medical/Equipment-Testing/.

Hand Tool Design and Musculoskeletal Disorders, p. 1, Cornell University Ergonomics Web, http://ergo.human.cornell.edu/DEA3250notes/handtool.html.

Kobalt 13-Piece 2-in Ratcheting Multi-Bit Screwdriver, Lowe's Companies, Inc., Mooresville, NC 28117, http://www.lowes.com/pd_170991-86580-SF14_.

* cited by examiner

ERGONOMIC HANDLE GOLF CLUB

BACKGROUND

Prior Art

The following is a tabulation of some prior art that presently appears relevant:

U.S. Patents

| Patent number | Kind Code | Issue date | Patentee |
|---|---|---|---|
| 8,105,179 | B1 | Jan. 31, 2012 | Allen, Donald T. |
| 6,343,997 | B1 | Feb. 5, 2002 | Allen, Don |
| 8,246,483 | B2 | Aug. 21, 2012 | Garno, Jeff |
| 0,066,163 | A1 | Jun. 6, 2002 | Lomax, Michael M. |
| 0,014,990 | A1 | Jan. 20, 2011 | Malcolm, Leighton R. |
| 0,120,560 | A1 | May 13, 2010 | Clancy, Brian T. |
| 7,708,651 | B2 | May 4, 2010 | Shin, Hyung In |
| 5,377,984 | A | Jan. 3, 1995 | Ciccia, Samuel |
| 3,533,630 | | Oct. 13, 1970 | LoMonaco, Vincent |
| 3,245,686 | | Apr. 12, 1966 | Hartmeister, Joel T. |
| 5,595,385 | A | Jan. 21, 1997 | Jablonski, Thaddeus M. |
| 8,012,037 | B2 | Sep. 6, 2011 | Evans, D. Clayton, et al |
| 5,976,030 | A | Nov. 2, 1999 | Hsieh, Chih-Ching |
| 7,997,997 | B2 | Aug. 16, 2011 | Bennett, Thomas Orrin, et al |
| 8,002,644 | B2 | Aug. 23, 2011 | Hocknell, Alan, et al |

Foreign Patent Documents

| Foreign Doc. Nr. | Cntry Code | Kind Code | Pub. Dt. | App of Patentee |
|---|---|---|---|---|
| 247658 | JP | A | Oct. 29, 2009 | Miyoko, Kawai |
| 2480090 | GB | A | Sep. 11, 2011 | Rippon, Smith Leslie |
| 0086285 | KR | A | Aug. 12, 2009 | Tae, Park Gyung |
| 100092 | AU | A4 | May 1, 2008 | John, Bugeja |
| 101461999 | CN | A | Jun. 24, 2009 | Xu, Tianyuan |

NON-PATENT LITERATURE DOCUMENTS

The Occupational Ergonomics Handbook, Second Edition
Fundamentals and Assessment Tools For Occupational Ergonomics
Anatomic vs. Physiologic Wrist Neutral Zone
Page 39-2
Edited by William S. Marrus and Wildemar Karwowski
Published 2006, CRC Press, Taylor and Francis Group
6000 Broken Sound Parkway NW
Suite 300 Boca Raton Fla., 33487-2742

Washington State Department of Social and Health Services
Range of Motion Evaluation Chart
Page 2
http://www.dshs.wa.gov/pdf/ms/forms/13_585a.pdf Tour Angle 144
Medallion Fulfillment and Logistics
20675 Nordhoff Street
Chatsworth, Calif. 91311
http://www.tourangle144.com Department of Health and Human Services, Centers for Disease Control and Prevention
National Institute for Occupational Safety and Health
Publications Dissemination
4678 Columbia Parkway
Cincinnati, Ohio 45226-1998
"Easy Ergonomics: A Guide to Selecting Non-Powered Hand Tools"
The California Department of Industrial Relations and the National Institute for Occupational
Safety and Health
2004
http://www.dir.ca.gov/dosh/dosh_publications/hand-tools.html United States Golf Association, "Equipment Permitted Conditionally for Medical Reasons"
Page 1 and 2
http://www.usga.org/equipment/medical/Equipment-Testing/Cornell University Ergonomics Web, "Hand Tool Design and Musculoskeletal Disorders"
Page 1
http://ergo.human.cornell.edu/DEA3250notes/hand-tool.html Kobalt Hand Tools
Kobalt 13-Piece 2-in Ratcheting Multi-Bit Screwdriver
Lowe's Companies, Inc.
Mooresville, N.C. 28117
http://www.lowes.com/pd_170991-86580-SF14_

A golf club consists of a shaft with a head on one end and a grip on the other end. The grip is in line with the axis of the shaft. The grip is grasped with both hands throughout the swing. The direction of swing is usually toward the side of the non-dominant hand. The swing is therefore from right to left for a right-handed golfer and reversed for a left-handed golfer.

The grip consists of material applied to the proximal end of the shaft. The grip is therefore the widened proximal segment of the shaft. Modifications have been made to the original grips. These modifications include alterations in the surface contour of the grip. Other modifications include the use of different materials and textures. Various types of ergonomic configurations have also been proposed. Current golf club designs generally have grips which are oriented in line with the axis of the shaft. The fundamental swing technique has also remained relatively unchanged. The configuration of the grip, method of grasp, and method of swing have many physiological problems as follows.

The wrists are in a position of ulnar flexion or deviation at the time of impact with the ball. Ulnar flexion is the position in which the wrists are flexed toward the side of the ulna bone of the forearm. Grasp of the club is achieved by placing each hand on the grip with the thumbs directed distally toward the club head. This degree of ulnar wrist flexion exceeds that of the physiologically neutral wrist position. The Occupational Ergonomics Handbook, Second Edition states that the wrist has 4 to 6 degrees of ulnar deviation in the anatomical neutral position. Grasp of the traditional grip is uncomfortable because the wrists are not is the physiologically neutral position.

Another disadvantage of ulnar wrist flexion is the limited range of motion in this direction. The maximum range of motion for ulnar flexion is approximately 30 degrees according to the Washington State Department of Social and Health Services. The wrists are not capable of attaining sufficient ulnar flexion to hold the club shaft in alignment with the axis of the arms. An angle is therefore formed between the axis of the club shaft and the axis of the arm. This is known as the shaft angle. Accurate strike of the ball requires a precise shaft angle. The proper shaft angle is difficult to replicate with each swing. Training aids such as the "Tour Angle 144" from Medallion Fulfillment and Logistics have been designed to assist the golfer in achieving a specific shaft angle. Nevertheless the shaft angle continues to complicate club alignment.

The misalignment of the axis of the shaft and the axis of the arms also has an adverse effect on the swing plane. The club and the arms are in separate swing planes. The center of rotation of the club is located substantially at the wrists. The center of rotation of each arm is located substantially at each respective shoulder. The traditional swing requires the golfer to coordinate the swing plane of the club with the swing plane of the arms. Control of the swing is difficult because the swing planes are not aligned together.

Rotation of the wrists and forearms is another problem with the traditional golf swing. Wrist and forearm rotation around the axis of the shaft occurs as the arms move forward during the swing. Rotation is needed to allow both arms to make a full swing while both hands maintain grasp of the linear shaped grip. This results in rotation of the club shaft around its axis during the swing. The club face is open in the backswing and closed in the follow-through. A substantially neutral or square club face position is needed at the time of ball strike. The degree of wrist rotation must be precisely coordinated with the timing of the swing to strike the ball accurately. The direction of ball flight will not be straight if wrist rotation is either early or late in relation to the timing of the swing.

The swinging motion of each arm is restricted when the traditional grip is grasped with both hands. This is because the center of the arc formed by the swing of the right arm is in a different location from that of the left arm. The swinging motion of one arm interferes with the swinging motion of the other arm. Compensatory flexion of each arm is needed to swing the club. The leading or forward arm has a relatively straightened elbow before strike of the ball. The trailing arm is more flexed at this point in the swing. This relationship reverses during the swing resulting in a more flexed leading arm and a more straightened trailing arm after strike of the ball. This relationship between flexion and extension of each elbow must be precisely controlled during the swing. Synchronized, simultaneous, simple circular motion of each arm is difficult to achieve.

Secure grasp of the traditional grip is compromised because the axis of the grip is located in the same axis as the shaft of the club. The apparent centrifugal force during the golf swing is oriented in a vector along the axis of the shaft in the distal direction. Grasp of the grip requires sufficient centripetal force to prevent the golf club from slipping longitudinally out of the hand. Changes in texture, materials, and surface contour of the grip have been made subsequently to attempt to achieve a more secure grasp. Modifications in gloves have also been made to attempt to improve the grasp. Nevertheless, current golf technology continues to have the axis of the grip oriented in line with the axis of the shaft. The club is therefore prone to slip from the grasp of the hands during the swing.

Secure grasp of the grip is also needed to prevent rotational slippage of the club around its axis. The grip is in the same axis as the shaft. Rotational slippage of the traditional grip within the grasp of the hands is possible.

The traditional method of grasp of the grip does not provide sufficient support for the force of angular acceleration during the swing. Angular acceleration is the rate of change in rotational displacement of the club during the swing. It results from the rotational force applied to the club. The traditional position of ulnar flexion of the wrists is less stable than the neutral position of the wrists. Accurate control of the club during angular acceleration is difficult with the traditional wrist position and method of swing. This can result in reduced club head speed.

Proper orientation of the face of the club when striking the ball is necessary. Closed or open club face position will result in misdirection of the ball to the left or right. The narrow caliber of the grip and orientation of the grip in line with the axis of the shaft requires the golfer to detect very small degrees of rotational orientation of the grip within the grasp of the hands. A slight clockwise or counter-clockwise deviation of the position of the grip will cause inaccurate direction of the ball flight. This can also result in unintended hook or slice of the ball flight.

Another problem associated with the traditional two handed grasp of the golf club is the torque force. Substantial force is applied to the shoulders, spine, hips, and knees during the swing and follow-through. The traditional two handed grasp of the grip results in considerable abduction of the forward arm and considerable adduction of the trailing arm at the end or terminal phase of the swing. The normal range of motion of the shoulder for abduction is 150 degrees and the normal range of motion for adduction is 30 degrees based on the Washington State Department of Social and Health Services. Follow-through of the arms is therefore limited primarily by the trailing arm when the club is grasped throughout the entire swing with the traditional technique. This limited range of motion results in excessive strain on the shoulder joints. The spine, hips, and knees are also subjected to a great degree of torque force. Release of the trailing arm during the swing would lessen the restriction on the leading arm, however the traditional grip configuration and method of grasp is difficult to control with one hand. Secure grasp with one hand is unstable due to the linear shape of the grip and ulnar flexion of the wrist.

Follow-through with the traditional golf club and swing technique is therefore restricted. This results in reduced club head speed. Distance and accuracy of the shot is also adversely affected. The swing is also uncomfortable due to excessive torque forces on the shoulders, spine, hips, and knees. Restriction of the swing and discomfort during the swing is prohibitive for certain individuals with arthritis or other disabilities of the shoulders, spine, hips, and knees.

Proper positioning of the golfers head is difficult to maintain with the traditional grip and method of swing. Torque force on the spine during the swing tends to draw the neck and head of the golfer in the same direction as the rotation of the trunk during the swing. Forward and downward directed position of the head is difficult to maintain against this force. Visual fixation on the ball is therefore difficult to maintain during the swing.

Attempts have been made to improve the mechanical problems associated with traditional golf clubs by addressing ergonomics. The Department of Health and Human Services, Centers for Disease Control and Prevention at the National Institute for Occupational Safety and Health states that a tool becomes "ergonomic" when it fits the task that is being performed and fits the hand without causing awkward postures, harmful contact pressures, or other safety and health risks. These risks include conditions such as carpal tunnel syndrome, tendonitis, or muscle strain. They also state that repetitive movements over time may result in damage to muscles, tendons, nerves, ligaments, joints, cartilage, spinal discs, or blood vessels. The United States Golf Association (USGA) has also addressed golf club design. The USGA publishes a list of equipment permitted conditionally for medical reasons for certain items manufactured at a commercial level. A report on the Cornell University Ergonomics Web states that the shape of tools can be modified "to avoid extremes of wrist deviation." This report states that allowing hand and forearm to remain in alignment during forceful grip exertion often requires special handle design.

Donald T. Allen describes a golf club having improved handle configuration (U.S. Pat. No. 8,105,179). This club has an attachable handle grip for each hand. It suffers from the disadvantage of having handles which are "on opposing sides of the shaft" from each other. The hands are separated from the axis of the shaft by a reinforcing member. The hands are also not aligned with each other along the axis of the shaft. The method of operation of the club involves a "push-pull motion" between the hands which results in a "whipping effect" during a golf swing. This motion must be coordinated with the swinging motion of the arms. This is a complicated swing technique which is difficult to precisely coordinate with the swing of the arms from the shoulders. Accuracy of ball strike is also difficult because the hands are not directly adjacent to the shaft. Another problem with this type of club is that the attachable handle grip is an assembly which is subject to loosening or misalignment during use.

Don Allen describes a golf club handle apparatus and double-handled golf club with forearm support (U.S. Pat. No. 6,343,997). This club apparatus can inhibit wrist flexion. This will reduce the speed of the club head during the swing. The technique also relies on the grasp of both hands throughout the swing. This results in excessive torque force on the spine and extremities. The apparatus includes "a pair of handles straddling a golf club shaft" for grasp of the hands. Accuracy of ball strike is again difficult because the hands are not directly adjacent to the shaft. The attachment of the forearm support member to the arm can result in excessive force on the arm. Contact of the club head with the ground during the swing can transfer excessive force to the arm. This can result in arm or shoulder injury. The apparatus is also more cumbersome to use than a simple handle grip.

Jeff Garno describes the single-arm golf club (U.S. Pat. No. 8,246,483). This club has a handle positioned at an angle from the axis of the club shaft. It also has a brace to stabilize the club with the forearm. It suffers from the disadvantage of limiting the complete free range of motion of the wrist for flexion and extension. This is because the arm-securing portion is "mechanically coupled" to the distal end of the grip portion. Reduced range of motion of the wrist can significantly limit the generation of club head speed during the swing. Constriction of the forearm by the arm-securing portion can interfere with comfortable expansion and contraction of the musculature. This constriction can also contribute to an encumbered sensation which will affect both the physical and psychological perception of a free swing. Perception of a restricted swing adversely affects control and power. The apparatus also involves precise fitting to the individual forearm of the golfer for optimal control of the club. The stability of the fit can decline with repeated use. This would require repeated adjustments to avoid inconsistent performance. Another problem results from potential slippage of the apparatus on the forearm. Sweat on the arm can compound this problem. A second handle is not adequately described for assistance with generation of power and control of the swing. An adequate description of the choice of arm for use with the apparatus is not clearly provided. An adequate description of the use of the contralateral arm with the swing is also not provided. Additional storage space is also needed in the golf bag for the apparatus.

Michael M. Lomax describes the ergonomic handle (U.S. Pat. No. 0,066,163). This handle has a triangular configuration. The ulnar aspect of the hand (supporting the fifth digit) is positioned along the axis of the shaft. This position of the hand interferes with the line of sight along the axis of the shaft. This would be a disadvantage for a golf club because visual alignment of the shaft with the arm would be difficult to achieve.

Leighton R. Malcolm describes a pair of adjustable handles for use with a golf club (U.S. Pat. No. 0,014,990). These handles are attached adjacent to the grip of the club shaft. One handle is located on each side of the grip. This club is proposed to allow pendulum motion but there is a separate pendulum motion for each arm. There is a separate swing plane for each shoulder. The golfer must try to coordinate the swing of each arm to achieve a single swing plane for the club. This club is also grasped with the wrists in the uncomfortable and non-physiologic position of ulnar flexion. The limited range of motion of ulnar flexion also creates a club shaft angle of less than 180 degrees. This angle is more difficult to consistently control during the swing than an angle of 180 degrees. Golf shots will be less consistent. The club shaft angle also results in a swing plane for the club which is not in alignment with the swing plane of the arms. Precise alignment of the shaft is difficult because the hands are not adjacent to the axis of the shaft. The pair of adjustable handles also has limited use because it is proposed for use with the putter only.

Brian Clancy describes the ergonomic sports handle (U.S. Pat. No. 0,120,560). This handle has a curved proximal end. Ulnar flexion is lessened but the wrist is still not in the physiologically neutral position. The Occupational Ergonomics Handbook, second edition states that a small degree of ulnar flexion of approximately 5 to 7 degrees is considered by some to be physiologically neutral. The ergonomic sports handle proposed by Clancy does not allow comfortable, simple flexion and extension of the wrist. The ulnar flexion does not allow the club to swing with a simple pendulum motion from the wrist. Another problem with this device is the lack of a second handle for the other hand to assist with power and control of the swing.

Kawai Miyoko describes the golf putter (JP patent 247, 658). This handle has a grip which is oriented toward the struck ball. The hand is therefore in a position of 90 degrees pronation when grasping the handle. This orientation of the wrist does not allow simple extension and flexion in the anterior/posterior direction during the swing. This device also places one hand in a different orientation from the other hand on the club. The hands are not aligned together along the axis of the shaft. This discrepancy in the orientation of each hand results in a mismatch of the muscle groups of each arm during the swing. Coordinated effort of the arms is therefore more difficult. Another disadvantage is the limitation to the putter.

Hyung In Shin describes the golf putter with an adjustable handle and a shaft that rotates about the handle and method for using the same (U.S. Pat. No. 7,708,651). This putter has a hinged attachment of the shaft to the handle. The shaft swings from the handle. The problem with this configuration and method of swing is that the pendulum motion of the club is defined by the hinged mechanism. This mechanism circumvents the skill of the golfer to supply the proper swinging motion of the club.

Samuel J. Ciccia describes the universal hand grip device (U.S. Pat. No. 5,377,984). The device is attached in a removable fashion by sliding it onto the golf club grip in a snug position. A disadvantage of this device is the intersection of the handle with the shaft. The shaft is positioned between the fingers when the handle is grasped. Secure grasp of the handle is therefore impaired. Another disadvantage is that the proximal end of the shaft extends over the palm of the hand and toward the wrist. This position of the shaft potentially interferes with simple wrist flexion. The abstract states a "right handed golfer would use the grip with his or her left hand and visa versa for a left handed golfer." The grip device, therefore, does not place the emphasis of the swing on the dominant or preferred hand. The line of sight for the golfer along the arm and shaft is also obstructed by the hand when addressing the ball. This can interfere with the visibility needed to properly align the club with the arm. The attachment between the handle and shaft is also prone to slip. This is because the handle is attached in a removable fashion by a snug fit rather than either a permanent attachment or an interchangeable mechanical attachment. This type of attachment of the handle is difficult to consistently position with the degree of precision which is needed for accurate ball strike. The club face could be inadvertently positioned in either an open or closed orientation. The stability of this attachment is also insufficient to resist the strong forces which are present during the swing and strike of the ball. Slippage of the club position can occur during the swing.

Vincent LoMonaco describes the golf club grip device (U.S. Pat. No. 3,533,630). This device has a handle which is clamped onto the grip of a golf club shaft. It suffers from similar disadvantages as the Universal Hand Grip Device by Samuel J. Ciccia above.

Joel T. Hartmeister describes the golf club with T-shaped handgrip (U.S. Pat. No. 3,245,686). This handgrip is oriented in a T-shaped configuration on the proximal end of the shaft. The connection with the shaft is positioned between the fingers of the hand. This configuration has the disadvantage of interfering with the alignment of the fingers on the handgrip. The middle finger and ring finger are separated by the segment which connects the handgrip with the shaft. Comfort and stability of the grasp of the hand is compromised. The line of sight along the arm of the golfer and shaft of the club is also interrupted by the position of the hand. This will interfere with the ability of the golfer to align the club when addressing the ball. The specifications also state that a right handed golfer grasps the handle with the left hand. This is reversed for a left handed golfer. The golfer uses the non-dominant hand for primary control of the swing on the T-shaped handgrip. This is a disadvantage because this hand tends to provide less control than the dominant hand. Another disadvantage of this golf club is the absence of an additional handle for the other hand of the golfer to assist with power and control of the swing.

Smith Leslie Rippon describes a golf club with a wide curved handle extending from the rear of the club head (GB patent 2,480,090). This golf club consists of a curved shaft and handle. It also suffers from the disadvantages associated with ulnar flexion of the wrists. The swing technique is also complicated by multiple swing planes, multiple centers of rotation, wrist rotation, limited range of motion for shoulder adduction and the resulting excessive torque forces as noted above. Alignment of the swing plane with the ball is also complicated by the curved shaft.

Thaddeus M. Jablonski describes the golf putter (U.S. Pat. No. 5,595,385). This club has a shaft which is curved away from the golfer at the proximal end. It is proposed that this club allows a pendulum swing. It suffers from the disadvantage of providing a poor line of sight along the axis of the shaft. The technique also utilizes the non-dominant hand to grasp the handle at the proximal end of the shaft. This extremity has less strength and control than the dominant extremity. Another disadvantage is the stated limitation of this apparatus to the putter.

Mechanical attachments between the grip and shaft have also been proposed. These mechanical attachments allow variety in the configuration and length of the golf club. They also allow interchangeability of various grips with the shaft. Several types of relevant mechanical attachments which have been described include a golf club with removable components by D. Clayton Evans, et al (U.S. Pat. No. 8,012,037), an adjustable golf club handle mounting arrangement by Chih-Ching Hsieh (U.S. Pat. No. 5,976,030), an interchangeable shaft system by Thomas Orrin Bennett, et al (U.S. Pat. No. 7,997,997), an interchangeable shaft for a golf club by Alan Hocknell, et al (U.S. Pat. No. 8,002,644), a detachable golf club by Park Gyung Tae (KR patent 0,086,285), an adjustable/extendable golf club handle by Bugeja John (AU patent 100,092), and a retractable golf rod by Tianyuan Xu (CN patent 101,461,999). Tools with mechanical attachments between the handle and shaft are also available. The "Kobolt 13-Piece 2-in Ratcheting Multi-Bit Screwdriver" is a commercially available attachment system for tools through Lowe's Companies Inc. which allows interchangeability of a handle with a shaft.

Mechanical attachments have been proposed for use with either traditional golf club designs or with hand held tools. These attachments allow a plurality of possible golf club lengths. They also allow a plurality of possible orientations of the club face position. An effective, lightweight, precise, easily adjusted mechanical attachment system has not yet been adequately proposed for use with an ergonomic golf club.

The golf club configurations and methods of swing heretofore known suffer from at least some of the following disadvantages:

(a) More than one center of rotation is involved in the swing.
(b) Single arm clubs have reduced power and club head speed.
(c) Adduction of the swinging arm is restricted and uncomfortable.
(d) Accurate club face orientation in the forward position is difficult to achieve because precise grasp of the grip on the shaft is difficult to achieve.
(e) Accurate club face orientation in the forward position is also difficult to achieve because rotation of the wrists around the axis of the club must be precisely coordinated with the timing of the swing.
(f) Grasp of the linear shaped traditional grip is prone to slip resulting in rotation of the club around the axis of the shaft.
(g) Grasp of the linear shaped traditional grip is also prone to slip resulting in longitudinal displacement of the club out of the grasp of the hands.
(h) Torque forces on the shoulders, spine, hips, and knees are excessive.
(i) Line of sight along the axis of the shaft is obstructed.
(j) Coordination of arm flexion and extension is difficult.
(k) Ulnar wrist flexion is uncomfortable.
(l) A consistent club shaft angle is difficult to maintain.
(m) Multiple swing planes are difficult to coordinate.
(n) A second handle has not been adequately described for assistance of the second hand with the swing.
(o) Stable position of the golfer's head is difficult to maintain during the swing.
(p) The proposed ergonomic handles have not all been shown to be applicable for the full set of clubs including the driver, wood, hybrid, iron, wedge, and putter.
(q) Mechanical attachments for quick, simple, precise, and secure interchange of ergonomic handles with shafts have not been adequately described.
(r) Mechanical attachments for quick, simple, precise, and secure adjustments of club length for ergonomic handles have not been adequately described.

(s) Mechanical attachments for quick, simple, precise, and secure adjustment of club face position for ergonomic handles have not been adequately described.

(t) Cumbersome or complicated apparatus.

(u) Wrist position is not neutral.

SUMMARY

In accordance with one embodiment an ergonomic handle golf club comprises a base attached to the proximal end of a shaft and a head on the distal end of the shaft. The base is substantially cylindrical in shape. The base and shaft are substantially in the same axis. Two handles extend from the base. The orientation of the each handle is at an angle relative to the axis of the base. The handles are directed substantially opposite to the orientation of the club head as they extend radially outward from the shaft. The handles allow a preferred hand to have substantial control of the swing and a non-preferred hand to assist with power and control.

ADVANTAGES

Accordingly several advantages of one or more aspects are as follows: to provide a golf club that allows the wrists to be in relatively neutral position at the time of impact with the ball, that is comfortable for the wrists, that allows substantially simple wrist flexion and extension during the swing, that allows a substantially single swing plane for the club and arm, that has a handle which allows the golfer to accurately and consistently orient the club face in a substantially forward direction, that makes club face orientation in the forward direction less difficult by reducing wrist rotation, that allows a firm grasp of the handle with reduced risk of unintended motion of the club within the grasp, that allows the preferred or dominant arm of the golfer to be primarily responsible for the swing path of the club, that allows the non-preferred arm to assist with power and control of the swing, that allows the non-preferred arm to release the club during the swing while the preferred arm is able to maintain strong control of the club throughout the swing, that reduces the demand for synchronized flexion of one elbow with extension of the other elbow, that allows strong grasp by the hand to apply centripetal force to the club during the swing, that allows improved angular acceleration for generation of club head speed, that reduces torque force on the shoulders, spine, hips, and extremities, that allows a less restricted swing by relying primarily on the abducting the arm during follow through, that allows the head of the golfer to be maintained in a substantially stable position directed downward toward the ball during the swing, that allows comfortable grasp by the hand with secure alignment of the fingers, that does not interfere with palmar wrist flexion, that has a secure attachment between the handle and shaft, that does not utilize a cumbersome apparatus, that does not involve mechanical parts which circumvent the responsibility of the golfer to define the swing plane, that can be stored easily in a golf bag, that can include all golf clubs including the driver, wood, hybrid, iron, wedge, and putter, that can be designed with mechanical attachments which allow secure, interchangeable and adjustable relationships between the shafts and bases for a plurality of different club lengths and club face orientations, and that are available in a plurality of base lengths which are interchangeable with the shaft to allow a plurality of club lengths. Other advantages of one or more aspects will be apparent from a consideration of the drawings and ensuing description.

DRAWINGS

Figures

In the drawings, closely related figures have the same number, but different alphabetic suffixes.

Drawings - Reference Numerals

Figure 1:
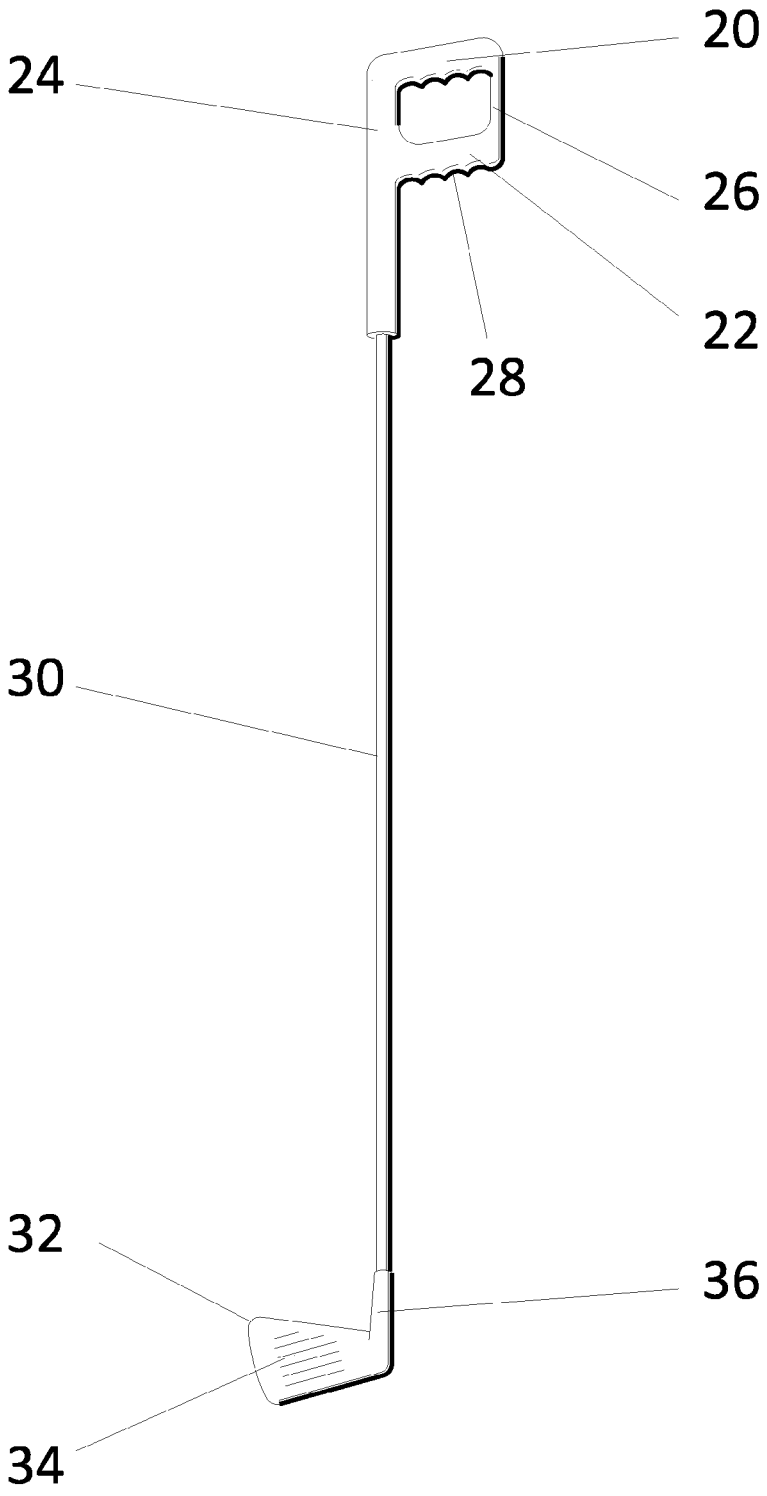
FIG. 1 shows an ergonomic handle golf club with a head consisting of an iron in accordance with one embodiment.
Figures 2A, 2B, 2C, 2D:
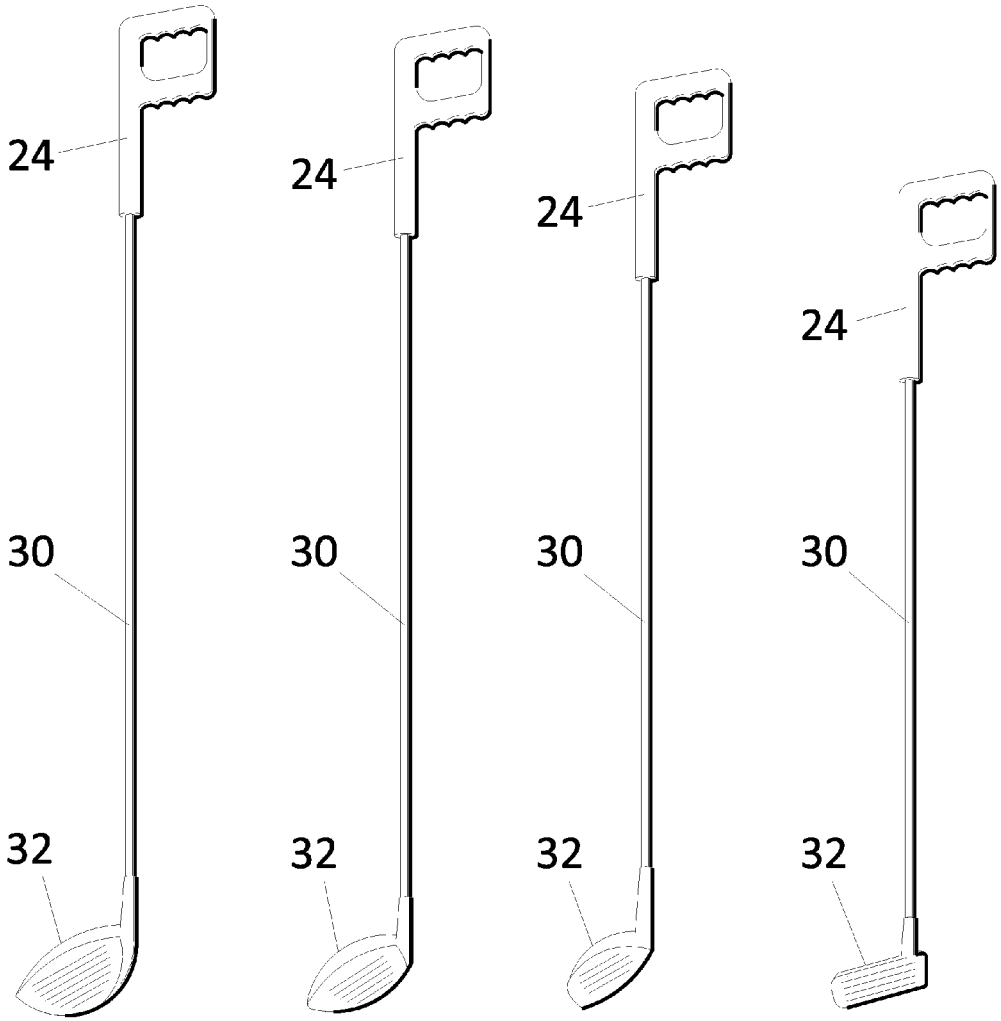
FIGS. 2A to 2D show ergonomic handle golf clubs having different heads including a driver, wood, hybrid, and putter respectively in accordance with other embodiments.

| | | | |
|---|---|---|---|
| 20 | proximal handle | 22 | distal handle |
| 24 | base | 26 | bridge |
| 28 | finger grooving | 30 | shaft |

-continued

| Drawings - Reference Numerals | | | |
|---|---|---|---|
| 32 | head | 34 | face |
| 36 | hosel | 38 | tightening nut |
| 40 | internal thread | 42 | external thread |
| 44 | base chamber | 46 | base receptacle |
| 48 | lip | 50 | flange |
| 52 | tongue | 54 | groove |
| 56 | barrel | 58 | barrel chamber |
| 60 | dial | 62 | stem |
| 64 | aperture | 66 | calibration lines |
| 68 | calibration notch | | |

DETAILED DESCRIPTION

FIG. 1

First Embodiment

One embodiment of the ergonomic handle golf club is illustrated in FIG. 1. A base 24 is attached to the proximal end of a club shaft 30. The orientation of the base 24 is in alignment with the axis of the shaft 30. The shape of the base 24 is substantially cylindrical with dimensions of approximately 25 cm in length and 2 cm in diameter. The base may be tapered at either end to provide relatively smooth contours. A proximal handle 20 extends radially outward from a point at or near the proximal end of the base 24. A distal handle 22 extends radially outward from a point on the base 24 which is distal to the location of the proximal handle 20. Each handle is directed outward from the shaft in a respective meridian which is substantially opposite the head. The distal handle 22 has an orientation which is substantially parallel to the proximal handle 20. The distance between the proximal handle 20 and the distal handle 22 is approximately 9 cm. There is an angle of approximately 95 to 97 degrees between the axis of each handle and the corresponding distal segment of the base. Angles of greater or lesser degree can also be used for individual fit or preference. The dimensions of both the proximal handle 20 and the distal handle 22 are approximately 12 cm in length, 2 cm in width, and 3 cm in depth. The handles have a shape which approximates the negative contour of the hand to allow for comfort and stability of grasp with the hand. Finger grooving 28 is located on the inferior aspect of each handle. The proximal handle 20 and distal handle 22 are connected by a bridge 26. The bridge 26 is attached to a point on each handle which is generally opposite the base 24. The bridge 26 has a substantially cylindrical shape with a diameter of approximately 1 cm. The bridge in this embodiment is substantially linear however a curved shape is also appropriate. The base 24, proximal handle 20, distal handle 22, and bridge 26 are a single unit, oriented substantially in a single plane. This unit is comprised of metal alloy or any other rigid material such as plastic, graphite, rubber, vinyl, steel, or any combination thereof. This material has sufficient strength to withstand the forces which bear upon a golf club during the swing and the impact with the ball and terrain. These materials are also suitable for bonding with the shaft 30. The base 24 is attached to the shaft 30 by a substantially durable bond in accordance with current manufacturing techniques.

A covering may be applied to the proximal handle 20, distal handle 22, base 24, and bridge 26. This is made of rubber, vinyl, leather, or any material which can improve the security and comfort of grasp by the hand.

A head 32 is anchored to the shaft 30 by a hosel 36. The head 32 in this embodiment is shown as an iron. The head 32 extends radially outward from the axis of the shaft 30. The orientation of the head 32 is at an angle of approximately 100 degrees from the axis of the shaft 30. A face 34 is the relatively flattened, forward-facing, striking surface of the head 32. The shaft 30, hosel 36, head 32, face 34 and method of attachment of the shaft with the hosel are manufactured in accordance with the current state of technology for each of the respective types of clubs including, but not limited to, the driver, wood, hybrid, iron, wedge, and putter.

The handles are directed substantially 180 degrees opposite from the head 32 as they extend from the shaft 30. The length of the shaft 30 is determined in part by factors which include height, arm reach, and swing plane orientation of the individual golfer.

Operation

FIG. 1

The proximal handle 20 is grasped with the preferred hand. The selection of hand is based on individual preference considering factors such and hand dominance or laterality. The distal handle 22 is grasped with the other hand. The method of grasp of each handle is performed with the thumb, or first digit, opposing the index finger, or second digit. The second through fifth digits are substantially aligned adjacent to each other. Finger grooving 28 on the inferior aspect of the proximal handle 20 and distal handle 22 is provided to receive each finger. The position of the base 24 is adjacent to the index finger on the lateral or thumb side of the hand. This position of the base 24 does not interfere with the alignment of the second through fifth digits. The base does not extend across the palm of the hand. This allows unrestricted palmar flexion of the wrist. Grasp of the handle is secure and comfortable.

The position of the golfer when addressing the ball is influenced by the hand preference of the individual. A golfer with a right hand preference will generally stand substantially on the right side of the ball in relation to the direction of aim. The right shoulder is positioned toward the forward direction of the swing. A golfer with a left hand preference will stand substantially on the left side of the ball in relation to the direction of aim. The left shoulder is positioned toward the forward direction of the swing. Consequently the address position for the golfer with dominant hand preference is generally on the opposite side of the ball from that of the traditional golf club and technique.

The club is held with the axis of the shaft 30 in substantial alignment with the axis of the preferred arm when addressing the ball. This corresponds to a shaft angle of approximately 180 degrees. The angle of each handle relative to the base is designed to allow the wrists to be in approximately 5 to 7 degrees of ulnar flexion. This wrist position approximates the physiologically neutral wrist position as described in The Occupational Ergonomics Handbook, Second Edition. This degree of ulnar flexion is comfortable and secure.

Ball strike is more accurate with this handle configuration for several reasons. An unobstructed line of sight is provided along the preferred arm, base 24, and shaft 30. Visual feedback from the position of the proximal handle 20 and distal handle 22 is related to the orientation of the face 34. Proprioceptive and kinesthetic feedback from the position of the proximal handle 20 and distal handle 22 assists the golfer with awareness of the orientation of the face 34. Improved awareness of the face 34 position results in greater precision of ball strike.

The stance of the golfer including spacing of the feet and degree of open or closed foot position is based upon individual preference. The degree to which the stance is opened or closed may also be adjusted for fade or draw shots respectively.

The address distance between the golfer and ball is influenced by the radius of the swing and position of the swing plane. A longer shaft 30 creates a larger radius and a more horizontal swing plane. The club head 32 extends further from the golfer. The distance of the golfer from the ball is increased accordingly. The shaft angle of the ergonomic handle golf club is approximately 180 degrees. This allows the swing plane to be oriented more vertically than that of the traditional club if desired. Clubs can be constructed with the heads at a plurality of angles in relation to the axis of the shaft to correspond to the angle of the swing plane.

The swing technique for the proximal handle consists of a swinging motion around a single center of rotation as follows. The proximal handle 20 is grasped with the preferred hand. This arm is then drawn back across the front of the chest into adduction in preparation for the swing. The trunk of the golfer is also rotated in this direction in preparation for the swing. The wrist, and elbow if desired, is in a position of flexion prior to the swing. The swing is performed by abduction of the preferred arm in a backhand fashion toward the ball as the trunk rotates toward the ball. The wrist and elbow extend during the swing. The combined effect of trunk rotation, shoulder abduction, elbow extension, and wrist extension generate angular acceleration of the golf club in a substantially single swing plane. The combined forces contribute to the synchronized generation of club head speed.

The elbow is in a relatively straight or extended position at the time of ball strike. The wrist is in a substantially neutral position at the time of ball strike. The arm proceeds forward and the trunk continues to rotate after the strike. Elbow flexion can be used during the terminal extent of the follow-through if desired.

Wrist motion is comprised of palmar flexion in the backswing and extension in the forward swing. Pronation and supination of the hand is substantially reduced. Clockwise or counterclockwise rotation of the wrist and forearm around the axis of the arm is also substantially reduced. The orientation of the club face 34 remains relatively stable during the swing when compared with the traditional club and swing technique. The face is less open in the backswing and less closed in the forward swing and follow-through. Control of the club is consequently improved for straight, fade, or draw shots. Accuracy is improved. Unintended slice or hook is also reduced.

The angle of the handles relative to the axis of the shaft allows the golfer to maintain strong centripetal force against the apparent centrifugal force on the club during the swing. The club remains securely in the grasp of the hand to reduce longitudinal and rotational slippage. The angled position of each handle also allows strong control of the club when striking uneven surfaces, sand, or tall grass where the toe or heel of the head may be subjected to variable degrees of resistance.

The club shown in FIG. 1 is designed for a golfer who prefers the left hand for control of the swing path of the club. The proximal handle 20 is grasped with the left hand. The face 34 is directed to the left side of the golfer. The choice of preferred hand is influenced by hand dominance as noted above. The choice of preferred hand may also be influenced by the specific characteristics of the individual golfer. Conditions such as arthritis, muscle weakness, or amputation may obviate the need for one hand over the other. Another factor in selecting the preferred hand is individual preference for swing direction. Some golfers may prefer the traditional direction of the golf swing. In this case a golfer would tend to use the non-dominant hand for grasp of the proximal handle 20.

The swing technique for the distal handle is complimentary to the technique for the proximal handle. The distal handle 22, and/or base 24 if desired, is grasped with the non-preferred hand and the arm is drawn back into abduction. This draws the club back in preparation for the swing. The trunk of the golfer is also rotated in this direction in preparation for the swing. The wrist is generally dorsiflexed and the elbow flexed prior to the swing. The swing is performed by adduction of the non-preferred arm in a forehand fashion toward the ball as the trunk rotates toward the ball. The wrist flexes in the palmar direction and the elbow extends during the swing. The non-preferred hand augments the preferred hand in generating angular acceleration, producing club head speed, and providing stable control of the club.

Grasp of the distal handle 22 can be released at any desired time during the swing. Early release of the distal handle 22 allows less restriction of follow-through by the preferred hand. This reduces the torque force on the golfer and improves stability of the trunk, hips, legs, and head during the swing. The head of the golfer is more readily able to remain oriented in a forward and downward position toward the ball during the swing. This facilitates stable visual fixation on the ball during the swing. Conversely, late release of the distal handle 22 provides additional control and stability of the club through the swing.

Fade and draw shots are accomplished by pronation or supination respectively of the hand on the proximal handle 22 at the time of ball strike. Pronation of the preferred hand on the proximal handle will open the club face. This is possible because the golf club is designed with a fixed relationship between the orientation of the face 34 and the orientation of the proximal handle 20 and distal handle 22. The degree of fade or draw is determined by the degree of pronation or supination. Visual and proprioceptive feedback form the proximal handle 20 and distal handle 22 provide strong cues to the golfer for orientation of the club face position. These cues are stronger than those of the traditional clubs because small changes in the rotational position of the shaft correspond to relatively large changes in the position of the handles.

The golfer can make adjustments in the reach of the club by adjusting the degree of flexion at the waist. Increased flexion will extend the reach. Decreased flexion will reduce the reach. This allows the golfer to make adjustments for terrain which is not level. A ball which is situated above the feet of the golfer tends to require less flexion at the waist. Conversely, a ball situated below the feet of the golfer tends to require greater flexion at the waist.

FIGS. 2A Through 2D

Additional Embodiments

FIGS. 2A through 2D show a plurality of embodiments of some alternative ergonomic handle golf clubs. Each club shown has a different head 32. These include a driver in FIG. 2A, wood in FIG. 2B, hybrid in FIG. 2C, and putter in FIG. 2D. Other clubs such as a wedge are also appropriate. Each club has a shaft 30 of a specified length. The shaft 30 is generally but not necessarily longest with the driver and generally shorter progressing to the wood, hybrid, iron, wedge, and putter. The base 24 is attached to the proximal end of the shaft 30. The proximal handle 20 and the distal handle 22 extend from the base.

Operation

FIGS. 2A Through 2D

The swing technique for each of the clubs is substantially similar to that of the iron. A plurality of variations on the technique are possible with each club. For example, grasp of the distal handle or base can be released at a specific point during the swing based on the individual type of club being used. Swing of the driver (FIG. 2A) generally has a long follow-through. Release of the distal handle, or base, shortly after ball strike allows a less restricted and more comfortable follow-through. The torque force on the shoulders, spine, hips, and knees is reduced. Swing of the wood (FIG. 2B) or hybrid (FIG. 2C) may require a full or partial follow-through depending on the desired distance of the shot. Release of the distal handle 22 or base 24 at a later point in the swing allows additional control of the club. Swing of the putter (FIG. 2D) generally involves a relatively short follow-through and low torque force. Grasp of the distal handle 22 through the entire follow-through allows a relatively greater degree of control.

FIGS. 3A Through 3F

Alternative Embodiments

FIGS. 3A through 3F show a plurality of embodiments of handle configurations and bridge designs. In each figure the base 24 is attached to the proximal end of the shaft 30 and the proximal handle 20 is located at or substantially near the proximal end of the base 24.

Figure 3A:
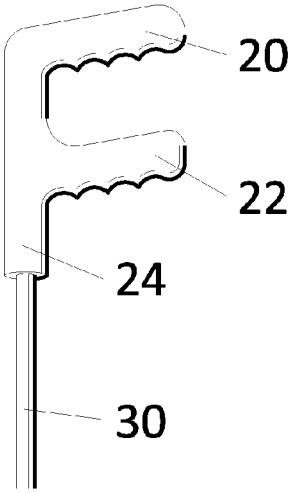
FIGS. 3A to 3F show various ergonomic handle configurations and shapes in accordance with other embodiments.
Figure 3B:
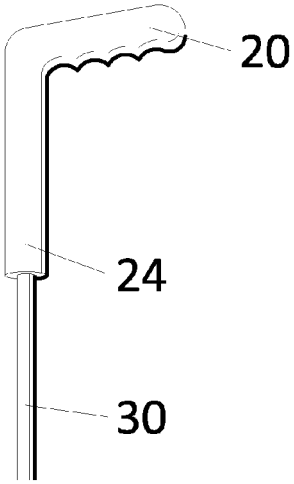
Figure 3C:
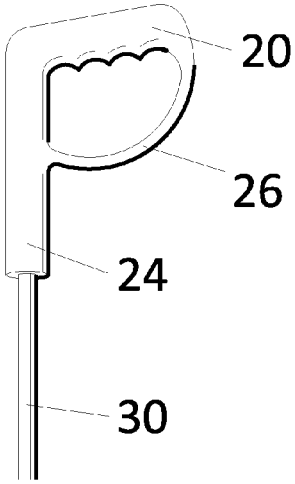
Figure 3D:
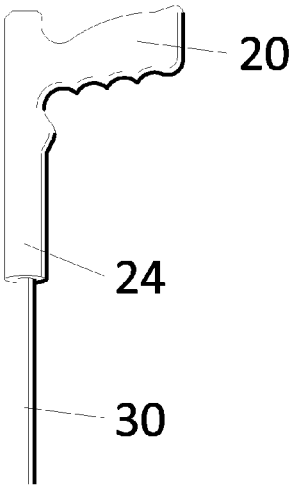
Figure 3E:
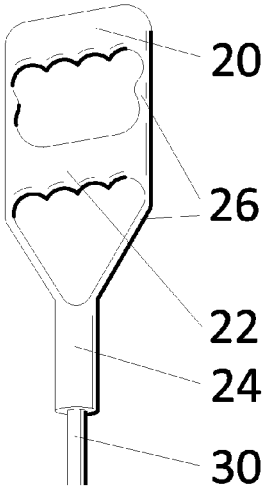
Figure 3F:
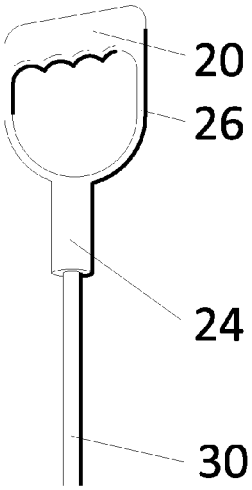

FIG. 3A shows a distal handle 22 extending from a point approximately 9 cm distal to the proximal handle 20. FIG. 3B shows a single, proximal handle 20. FIG. 3C shows a single bridge 26 extending from approximately the free end of the proximal handle 20 to a point on the base 24 which is approximately 9 cm distal to the proximal handle 20. FIG. 3D shows a single proximal handle 20. This handle has a contoured shape. The contours of the handle can be customized based on the physical characteristics or preferences of the individual golfer. FIG. 3E shows a distal handle 22 approximately 9 cm distal to the proximal handle 20. Each handle is substantially centered over the axis of the base 24. A bridge 26 extends from one end of the proximal handle 20 to the corresponding end of the distal handle 22 and continuing to the proximal end of the base 24. A similar bridge is located on the other end of each handle. FIG. 3F shows a single, proximal handle 20. The handle is substantially centered over the axis of the base 24. A bridge 26 extends from one end of the proximal handle 20 to the proximal end of the base 24. A similar bridge is located on the other end of the proximal handle 20.

In FIGS. 3A through 3F, the angle between each handle and the more distal segment of the base 24 is approximately 95 to 97 degrees. Angles of greater of lesser degree can also be used based on individual golfer fit and preference. The proximal handle 20, distal handle 22, base 24, bridge 26, and shaft 30 are located substantially in the same plane in each figure.

Operation

FIGS. 3A Through 3F

A plurality of some of the possible handle configurations are shown in FIGS. 3A through 3F. The variety provides for the specific needs and preferences of the individual golfer. The bridge shown in FIG. 3C adds strength and stability. The absence of the bridge in FIG. 3A, FIG. 3B, and FIG. 3D provides a more open feel. A single handle design is appropriate for the golfer who would rather grasp the base than the distal handle. It is also appropriate for the golfer who prefers a single hand technique, has physical limitations with one upper extremity, or is an amputee.

The more contoured handle shown in FIG. 3D improves stability of the grasp. Any desired contour can be constructed. Contours can also be custom constructed for the individual golfer.

Centered handles over the axis of the base would allow the axis of the shaft to be substantially aligned with the center of the axis of the golfers arm. Some golfers may prefer this alignment over the line of sight alignment described above.

Alternative handles, bases, and bridges include variations in length, width, depth, shape, and contour. Finger grooving of various sizes and shapes is optional. Location of the proximal and distal handles on the base can be individualized. The distance of separation between the proximal and distal handles can be individualized. Location of the bridge or bridges can be individualized. An outer wrap or covering on the base, handles, or bridge can be used. This covering can include leather, rubber, vinyl, or any material which can be securely attached for comfort and stability of the grasp. Any desired shaft length can be used.

Figure 4A:
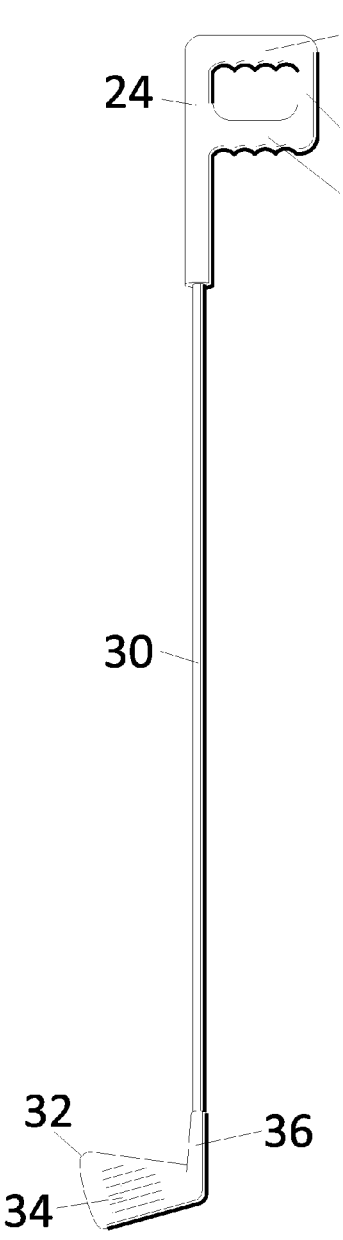
FIGS. 4A to 4C show ergonomic handle golf clubs having various vertical relationships between the angle of the handles and the angle of the head in accordance with other embodiments.
Figure 4B:
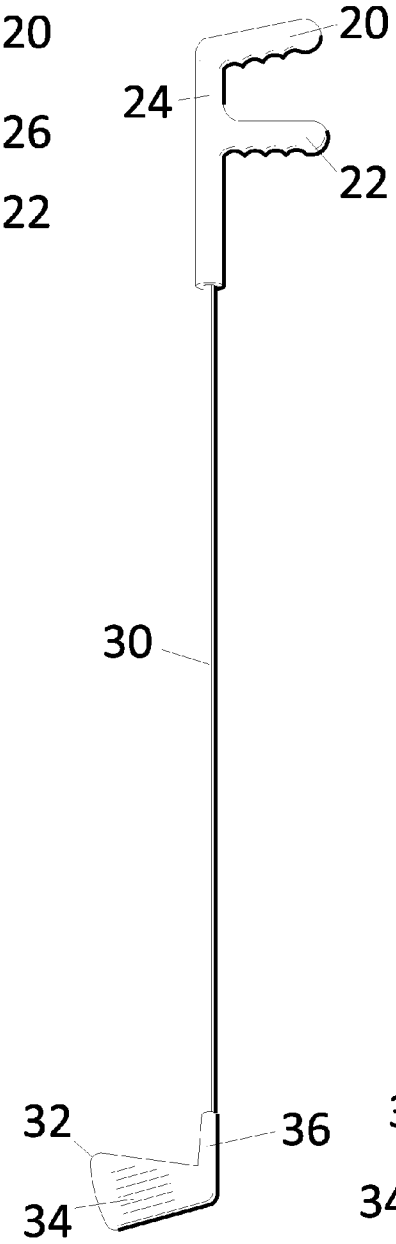
Figure 4C:
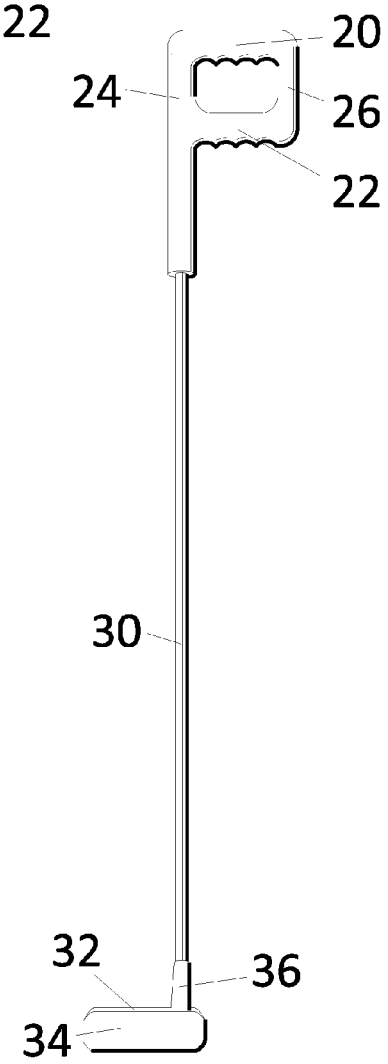

FIGS. 4A Through 4C

Additional Alternative Embodiments

FIGS. 4A through 4C show embodiments of variations on the relationship between the vertical angle of the proximal handle 20, distal handle 22, and head 32 relative to the axis of the shaft 30. These components are shown in substantially the same plane. The proximal handle 20 and distal handle 22 extend from the base 24 in each figure. The base 24 is attached to the proximal end of the shaft 30. The shaft 30 is attached to the head 32 by a hosel 36. The face 34 of each club is the forward facing striking surface. The face 34 is oriented in a meridian around the axis of the shaft which is substantially 180 degrees away from the meridian of the proximal handle 20 and distal handle 22.

FIG. 4A shows the proximal handle 20 and distal handle 22 at an angle of 90 degrees from the axis of the base 24. A bridge 26 extends substantially from the free end of the proximal handle 20 to the free end of the distal handle 22. The head 32 is an iron. The angle between the head 32 and the axis of the shaft 30 is approximately 100 degrees.

FIG. 4B shows the proximal handle 20 at an angle of approximately 100 degrees relative to the axis of the base 24. The distal handle 22 is at an angle of 90 degrees relative to the axis of the base 24. The other end of the both the proximal handle 20 and the distal handle 22 is free of attachment. The head 32 is an iron. The angle between the orientation of the head 32 and the axis of the shaft 30 is approximately 100 degrees.

FIG. 4C shows the proximal handle 20 and distal handle 22 at an angle of 90 degrees from the axis of the base 24. A bridge 26 extends substantially from the free end of the proximal handle 20 to the free end of the distal handle 22. The head 32 is a putter. The angle between the head 32 and the axis of the shaft 30 is approximately 90 degrees.

These figures illustrate three of many possible interrelationships between the vertical angle of the proximal handle 20, distal handle 22, and head 32 relative to the axis of the base 24 and shaft 30. Any configuration can be used with any type of club including the driver, wood, hybrid, iron, wedge, or putter.

Operation

FIGS. 4A Through 4C

The plurality of possible vertical angles for the proximal handle 20 and distal handle 22 allow many possible wrist positions. Comfort is optimized and individualized. An angle of approximately 95 to 97 degrees between the proximal handle 20 and the axis of the base 24 allows the wrist to be in approximately 5 to 7 degrees of ulnar flexion. This is a substantially neutral wrist position which allows the shaft 30 to be essentially aligned with the axis of the arm. The swing planes of the shaft and arm are also substantially aligned.

An angle other than 95 to 97 degrees between either handle and base can also be used. A golfer with a neutral wrist position of either greater or less than 5 to 7 degrees of ulnar flexion would benefit from a handle with a corresponding angle. The individual preference of each golfer can also be taken into consideration.

The specific angle of the handles can also be chosen for the purpose of providing a shaft angle which is larger or smaller than 180 degrees if desired by the individual golfer. This plurality of possible shaft angles allows the swing plane to be oriented either more horizontally or vertically if desired. The orientation of the head 32 can be set at an angle which corresponds to the swing plane. A larger angle of the head corresponds to a more horizontal swing plane. An angle of approximately 90 degrees corresponds to a more vertical swing plane. Individualized angles of the handles and heads allow custom fitting of the clubs. For example, a golfer who has a neutral wrist position of 5 degrees of ulnar flexion can be fitted with a putter having handles oriented at 95 degrees from the axis of the base. This results in a 180 degree shaft angle. If this golfer also chooses to use a vertical swing plane, the head can be designed at 90 degrees. This configuration allows the golfer to putt with a simple pendulum swing technique. The club face is less prone to open or close during the swing. The accuracy of the putt is improved.

Figure 5A:
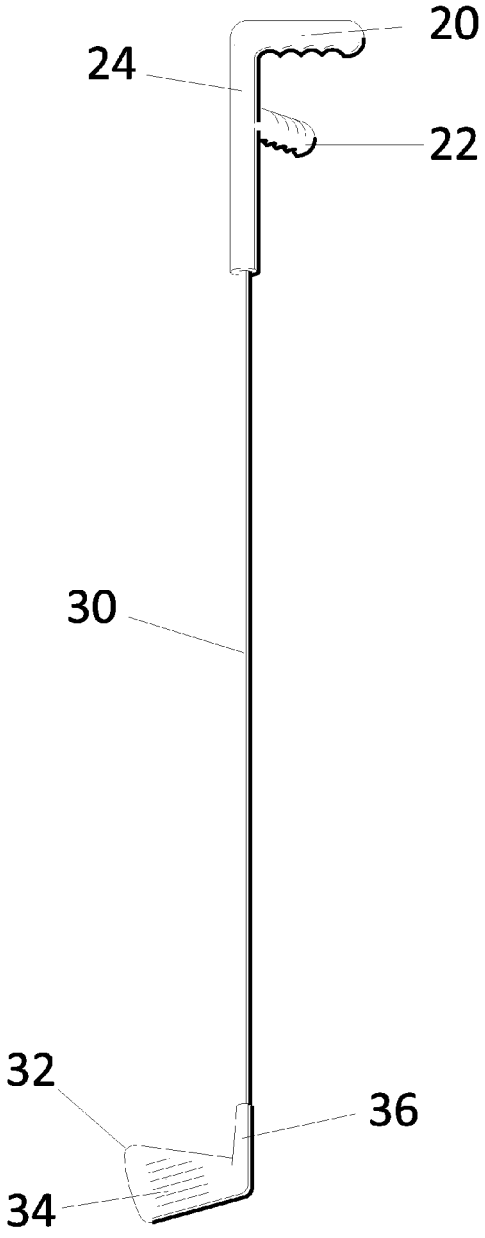
FIGS. 5A and 5B show ergonomic handle golf clubs with the handles in separate meridians and separated by different distances in accordance with other embodiments.
Figure 5B:
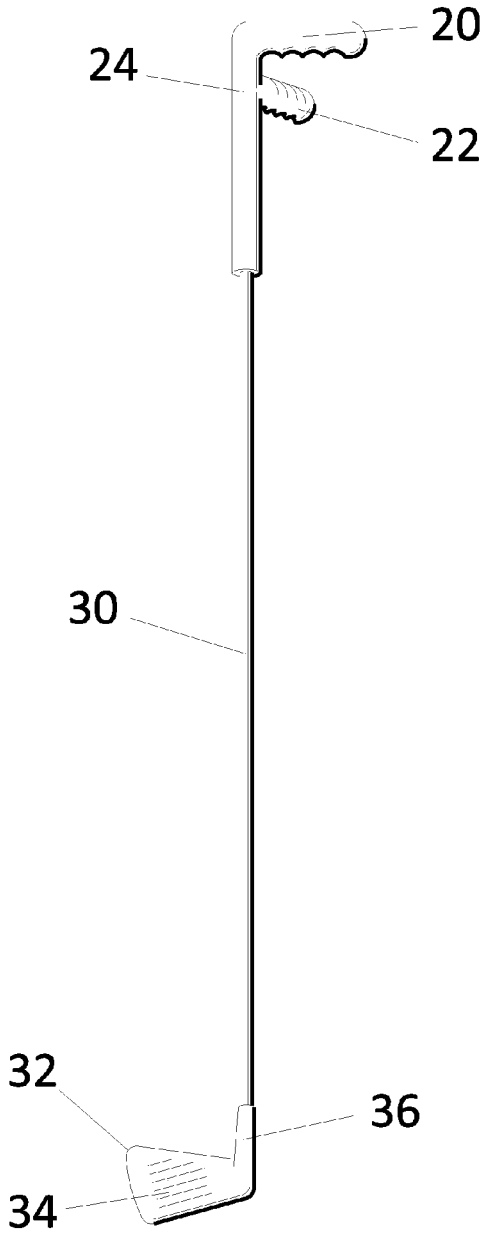

FIGS. 5A and 5B

Additional Alternative Embodiments

FIG. 5A shows an embodiment with the proximal handle 20 and distal handle 22 each extending radially outward from the base 24. The handles are extending from respective points on the base which are separated by approximately 9 cm. Each handle is extending out with a vertical angle of approximately 90 degrees from the axis of the base 24. The horizontal orientation of the proximal handle 20 and distal handle 22 are not in the same meridian around the axis of the base 24. The meridian of the proximal handle 20 is approximately 180 degrees away from the meridian of the face 34. The meridian of the distal handle 22 is approximately 45 degrees counterclockwise, relative to the perspective of the golfer, from the meridian of the proximal handle 20.

FIG. 5B shows an embodiment with the proximal handle 20 and distal handle 22 extending from respective points on the base which are separated by approximately 3 cm. The orientation of each handle is in a similar meridian as shown in FIG. 5A.

In both FIG. 5A and FIG. 5B the club head 32 is attached by a hosel 34 to the distal end of the shaft 30. The club face 34 is oriented in substantially the same plane as the proximal handle 20.

These figures show two possible relationships between the meridian of the proximal handle 20, distal handle 22, and face 34. Any other possible interrelationship between the angles of these components may be used.

Operation

FIGS. 5A and 5B

The available variety of specific meridians for the proximal and distal handles allows clubs to be constructed for the individual needs and preferences of the golfer.

Individual physiologic wrist position which deviates from neutral position into either pronation or supination can be accommodated by a club configuration with the handle oriented in a compensatory meridian. Unintended pronation of the preferred hand can be corrected by constructing a club with less than 180 degrees between the meridians of the proximal handle 20 and the face 34. Unintended supination of the preferred hand can be corrected by constructing a club with greater than 180 degrees between the meridians of the proximal handle 20 and the face 34. Similar adjustments can be made for the distal handle as needed.

Clubs can also be constructed for draw or fade shots. A specified degree of open or closed club face position can be achieved by constructing the club with the face 34 in a different plane than the proximal handle 20. A closed face can be used for draw shots. An open face can be used for fade shots.

The separation between the proximal handle 20 and distal handle 22 along the base can be specifically designed for the preference of the individual golfer. This will influence the mechanical advantage and the generation of force during the swing. Greater separation between the handles creates a longer lever arm and increases the mechanical advantage.

The plurality of optional interrelationships between the horizontal angles, vertical angles and separation of the handles allow custom fitting of the clubs for the individual needs and preferences of the golfer. The comfort and control of the swing is improved. "Yips" and other swing flaws can be potentially ameliorated.

FIGS. 6A Through 13C

Mechanical Embodiments

Figure 6A:
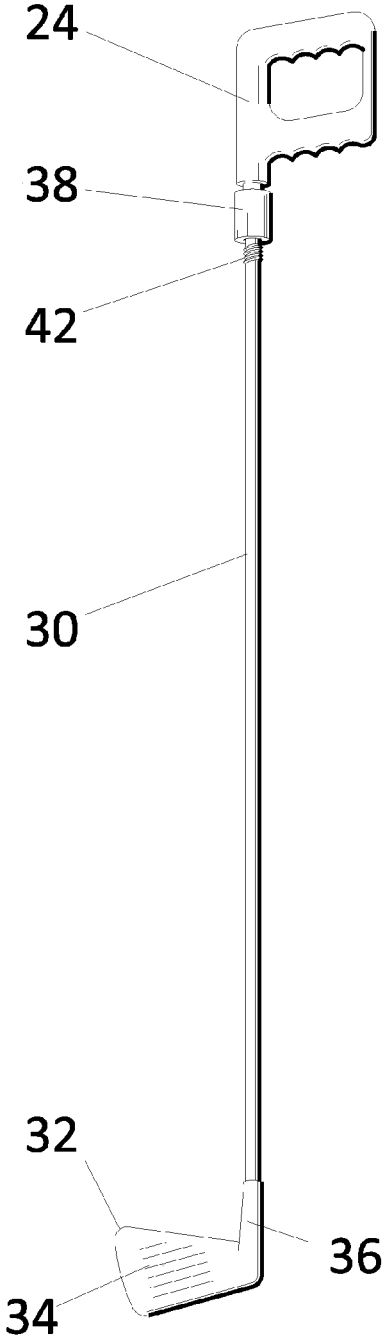
FIGS. 6A and 6B show ergonomic handle golf clubs with a mechanical attachment for the base and shaft in assembled and disassembled states in accordance with other embodiments.
Figure 6B:
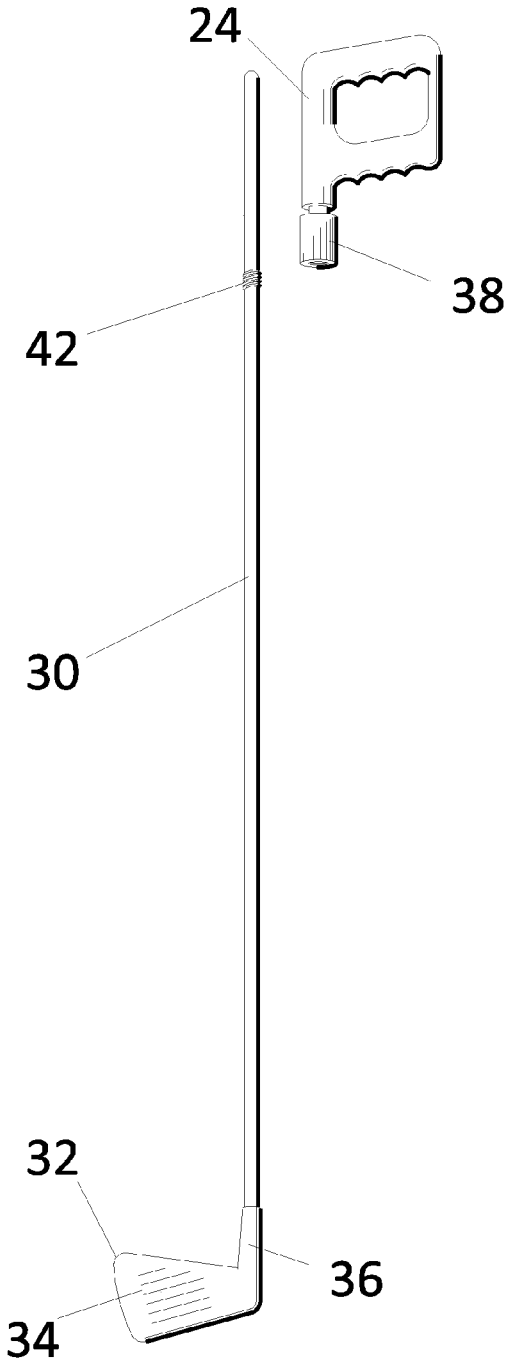

FIG. 6A through 13C show various embodiments of a mechanical attachment between the base 24 and shaft 30. FIG. 6A shows the shaft 30 inserted into the base 24. A tightening nut 38 on the distal end of the base 24 is available to receive an external thread 42 on the shaft 30 to provide a secure connection. FIG. 6B shows the shaft 30 disassembled from the base 24. The most proximal segment of the shaft 30 is revealed because it is removed from the base 24. The head 32, face 34, and hosel 36 are also shown in FIGS. 6A and 6B.

Figure 7:
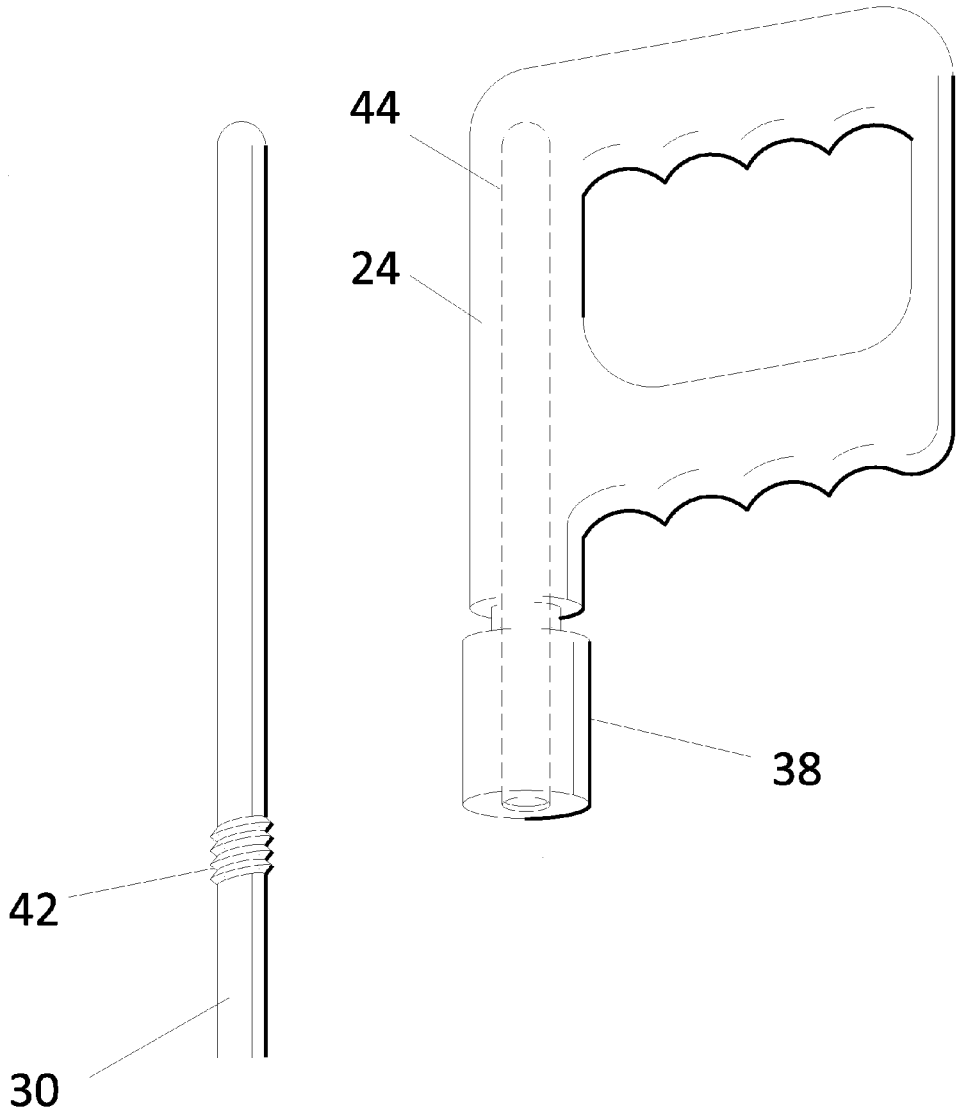
FIG. 7 shows an enlarged view of a mechanical ergonomic handle disassembled from the shaft in accordance with another embodiment.

FIG. 7 shows an enlarged view of the base 24. The proximal end of the shaft 30 is removed from the base 24 revealing the external thread 42. Hidden lines show the position of the base chamber 44.

Figure 8A:
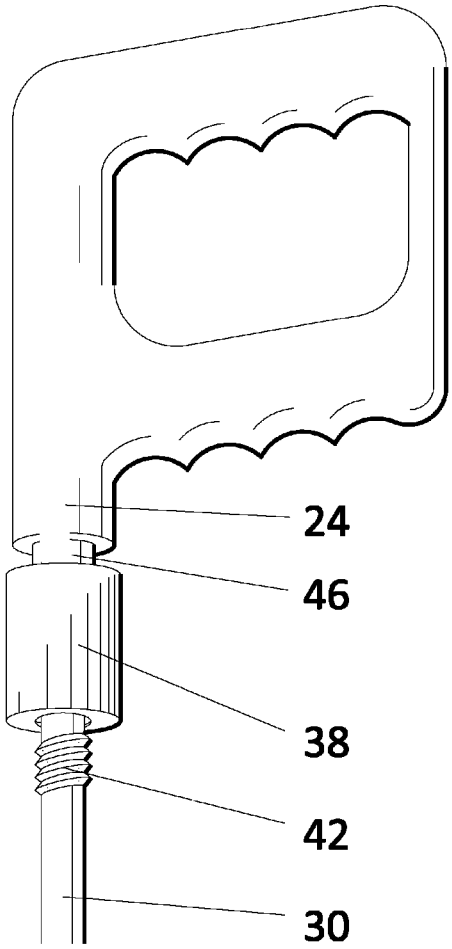
FIGS. 8A and 8B show mechanical ergonomic handles with the tightening nut in the loosened and tightened positions in accordance with other embodiments.
Figure 8B:
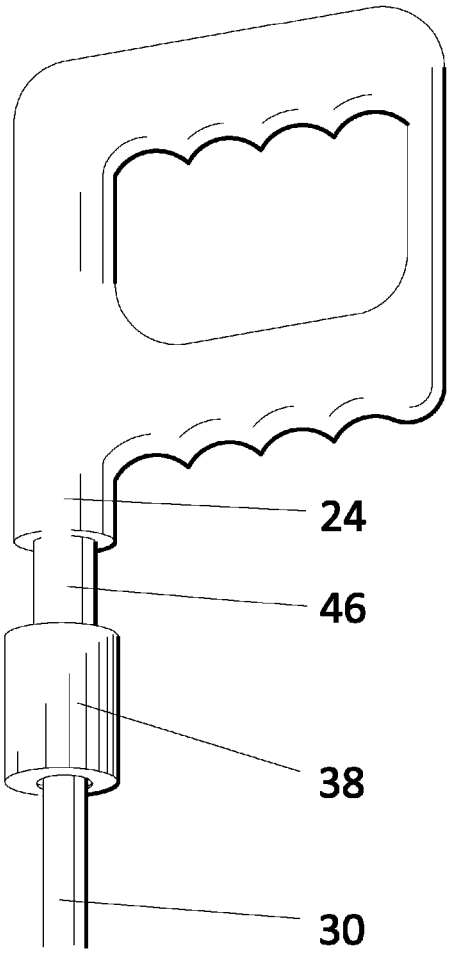

FIGS. 8A and 8B show enlarged views of the attachment between the base 24 and shaft 30. FIG. 8A shows the tightening nut 38 in the loosened or proximal position. A base receptacle 46 is the distal, narrow portion of the base 24 which articulates with the tightening nut 38. The external thread 42 on the shaft 30 is visible because the tightening nut 38 is in the proximal position. FIG. 8B shows the tightening nut 38 in the tightened or distal position. A greater length of the base receptacle 46 is revealed extending from the base 24. The external thread on the shaft 30 is not visible because it is secured within the tightening nut 38.

Figure 9:
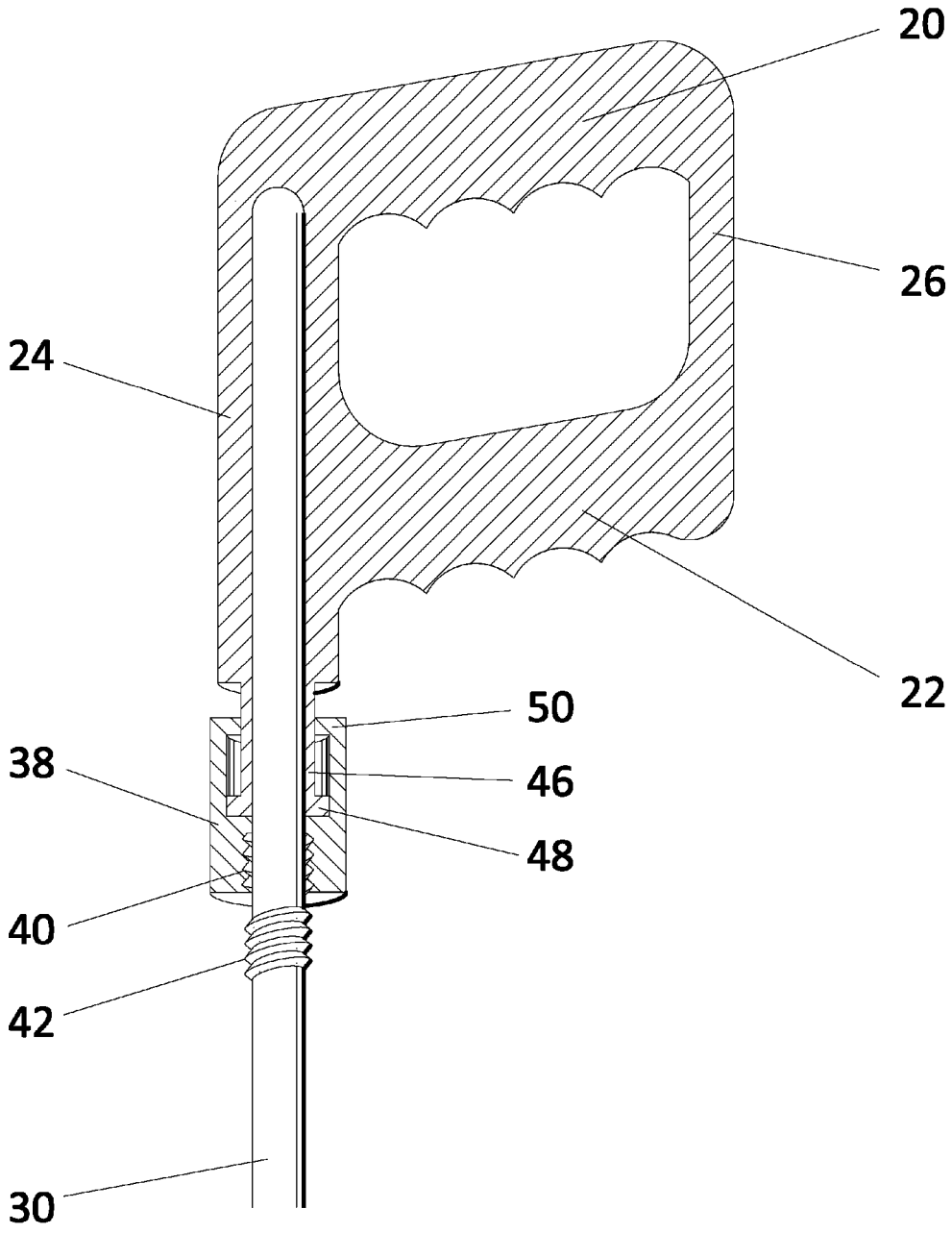
FIG. 9 shows a sectional view of a mechanical ergonomic handle with club shaft in place in accordance with another embodiment.

FIG. 9 shows a sectional view of a mechanical ergonomic handle including the proximal handle 20, distal handle 22, bridge 26, base 24, base receptacle 46, and tightening nut 38. The proximal end of the shaft 30 is inserted through the tightening nut 38 and base receptacle 46 into the base 24. A lip 48 on the distal end of the base receptacle 46 retains a flange 50 on the proximal end of the tightening nut 38. This prevents separation of the tightening nut 38 from the base receptacle 46. The internal thread 40 of the tightening nut 38 is not articulating with the external thread 42 on the shaft 30 because the tightening nut 38 is in the loosened position.

Figure 10A:
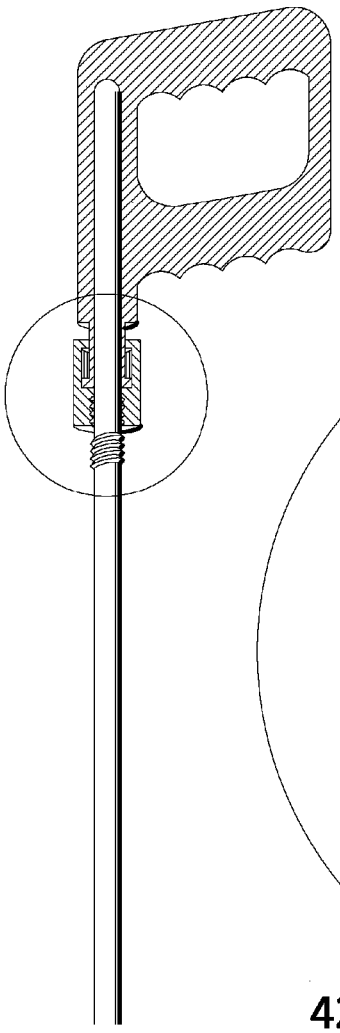
FIGS. 10A and 10B show a sectional view of a mechanical ergonomic handle with the shaft in place and an enlarged view of the mechanical attachment in accordance with other embodiments.
Figure 10B:
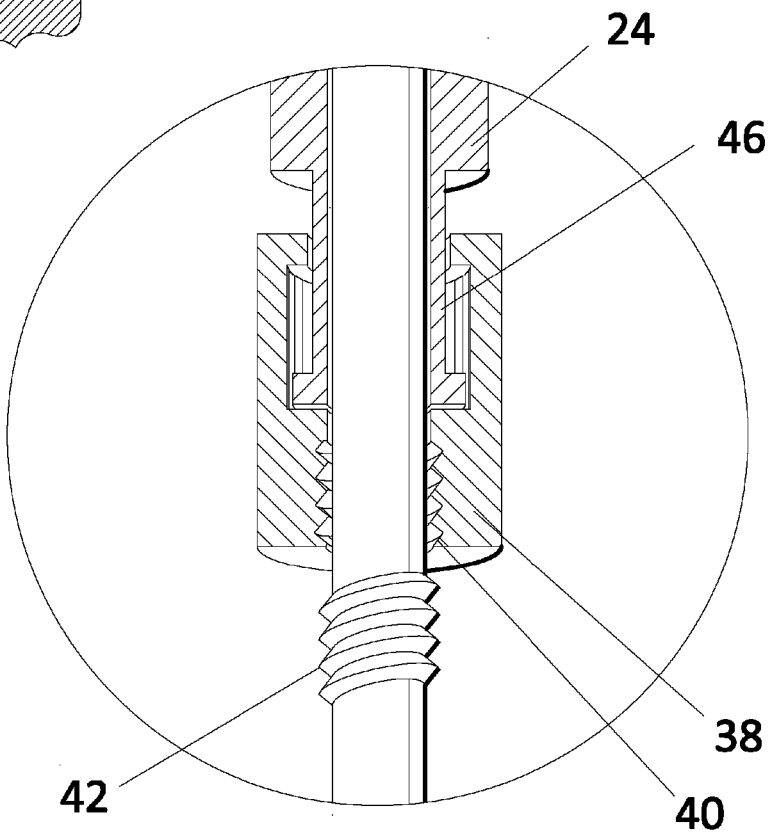

FIG. 10A shows a sectional view of a mechanical ergonomic handle with an encircled area around the mechanical attachment. The encircled area is enlarged in FIG. 10B. The base 24, base receptacle 46, tightening nut 38, internal thread 40, and external thread 42 are shown. The tightening nut 38 is in the loosened position.

Figure 11:
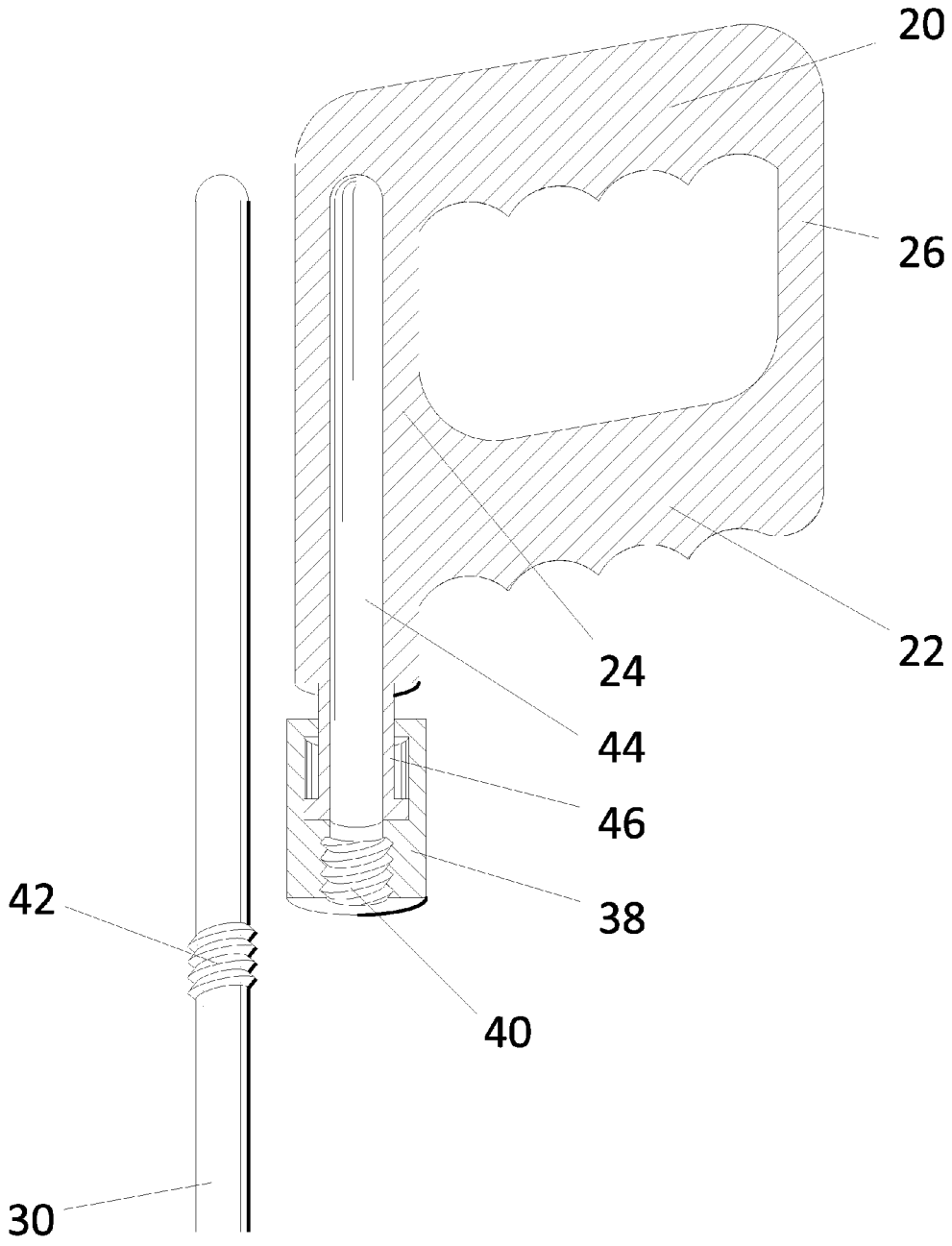
FIG. 11 shows a sectional view of a mechanical ergonomic handle with the shaft separated in accordance with another embodiment.

FIG. 11 shows a mechanical ergonomic handle with the shaft 30 removed from the base 24. A sectional view of the proximal handle 20, distal handle 22, bridge 26, base 24, base receptacle 46, and tightening nut 38 is shown. The inside of the base chamber 44 and internal thread 40 of the tightening nut 38 are revealed. The shaft 30 with external thread 42 is also visible.

Figure 12:
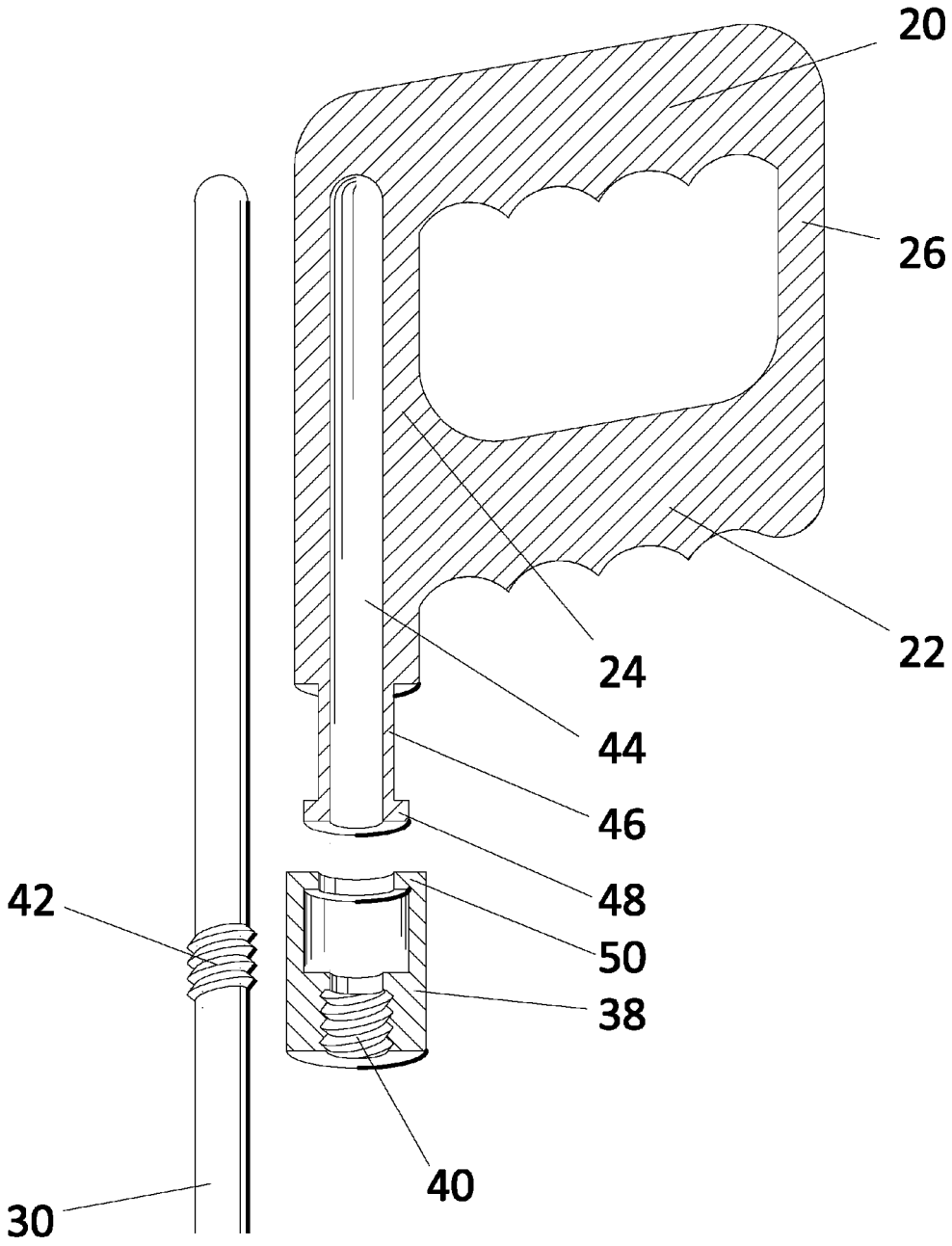
FIG. 12 shows a sectional view of a mechanical ergonomic handle with the shaft separated and tightening nut removed in accordance with another embodiment.

FIG. 12 shows a mechanical ergonomic handle with the shaft 30 removed from the base 24. A sectional view of the proximal handle 20, distal handle 22, bridge 26, base 24, base receptacle 46, and tightening nut 38 is shown. The sectional view reveals the inside of the base chamber 44. The articulation between the tightening nut 38 and the base receptacle 46 is separated to show more detail. The lip 48 on the end of the base receptacle 46 is shown. The flange 50 on the proximal end of the tightening nut 38 is also shown.

Figure 13A:
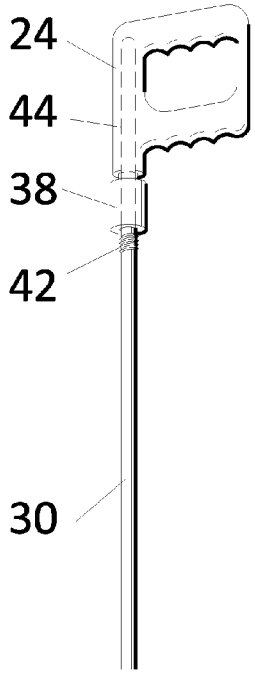
FIGS. 13A to 13C show mechanical ergonomic handles having various base lengths in accordance with other embodiments.
Figure 13B:
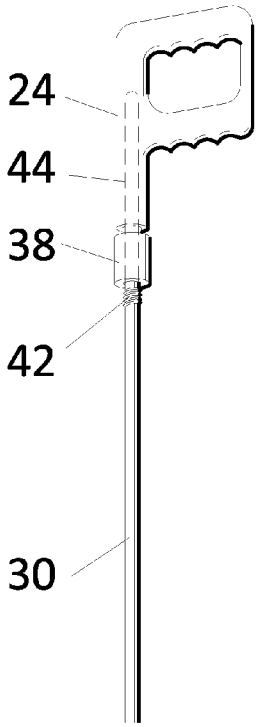
Figure 13C:
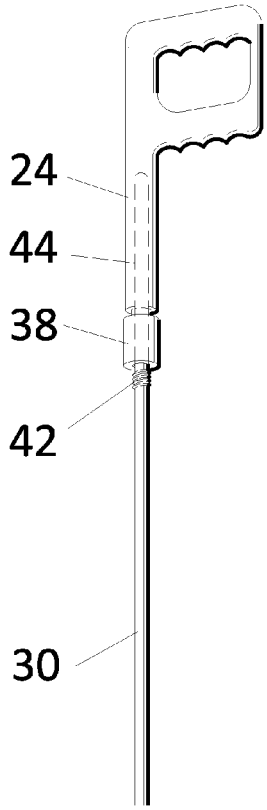

FIGS. 13A through 13C show mechanical ergonomic handles with progressively longer length of the base 24. Hidden lines show the position of the base chamber 44. The length of the base chamber 44 is similar in each figure. The shaft 30 is fully inserted into the base chamber 44. The overall club length is shortest in FIG. 13A. The overall club length is longer in FIG. 13B and longest in FIG. 13C. The tightening nut 38 is in the loosened position and the external thread 42 is therefore visible in each figure.

Operation

FIGS. 6A Through 13C

The mechanical attachments shown in these embodiments allow quick and efficient interchange of shafts with handles. Rotation of the tightening nut 38 allows the external thread 42 of the shaft 30 to mate with the internal thread 40 of the tightening nut 38. The shaft 30 is thereby secured to the base 24. The tightening nut is moved proximally or distally within a specified range as it is loosened or tightened respectively. This is one example of a plurality of possible mechanical attachment systems which are simple, durable, secure, and lightweight. The club can be securely assembled for play and disassembled for storage in the golf bag. The interchange of multiple shafts with one or several mechanical ergonomic handles saves space in the bag and reduces the overall weight of the set of clubs.

The shaft can also be secured to the base in any desired orientation around the axis of the shaft. This allows a predetermined degree of draw or fade for specific shot shapes. The club can be prepared for a fade shot, for example, by positioning the face in a 10 degree open position before securing the tightening nut. With this configuration the golfer can maintain the wrist and forearm in neutral position rather than pronation of 10 degrees to achieve a fade shot.

Natural deviation of the wrist and forearm in either the prone or supine position can be offset by adjusting the orientation of the shaft in the chamber. This will square the club face with the ball and tend to prevent misdirection of the shot, unintended hook, or unintended slice.

Overall club length can also be changed quickly if a plurality of base lengths are available. A longer base length results in a longer overall club length. A shorter based length results in a shorter overall club length. A golf ball which is positioned on a surface having an incline or decline of the terrain requires an adjustment in the reach of the club. The golfer can maintain substantially the same posture for a shot on any topography by selecting a base of appropriate length.

These embodiments show one possible mechanical attachment system. Other types of mechanical attachment systems which allow interchange of shafts and adjustment in orientation of the shaft may also be appropriate. The mechanism incorporated in the "Kobalt SpeedFit 13-in-one Ratcheting Handle" through Lowe's Companies Inc. is an example of a tool system which allows quick interchange of components. Systems such as this can be adapted for use with the ergonomic handle golf club.

FIGS. 14A Through 14D

Alternative Mechanical Embodiments

Figure 14A:
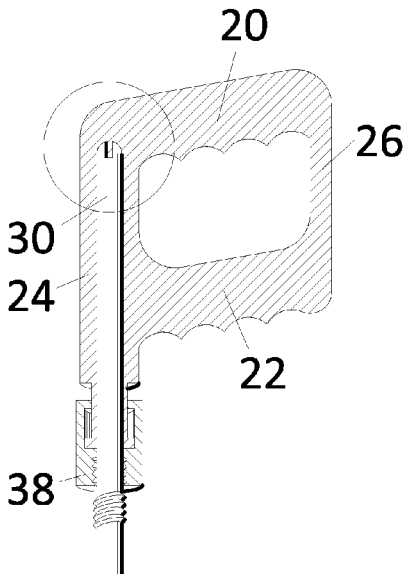
FIGS. 14A to 14D show a sectional view of a mechanical ergonomic handle with a tongue and groove stabilizer, and isolated views in accordance with other embodiments.

FIGS. 14A through 14D show embodiments of a tongue and groove system for stabilizing the shaft 30 within the base 24. An encircled area of the proximal base 24 and shaft 30 is shown in FIG. 14A and enlarged in FIG. 14B. The proximal end of the shaft is shown in end view in FIG. 14C and oblique view in FIG. 14D.

FIG. 14A shows a sectional view of the base 24, proximal handle 20, distal handle 22, bridge 26, and tightening nut 38. The proximal portion of the shaft 30 is inserted into the base 24. The tightening nut 38 is in the loosened position.

Figure 14B:
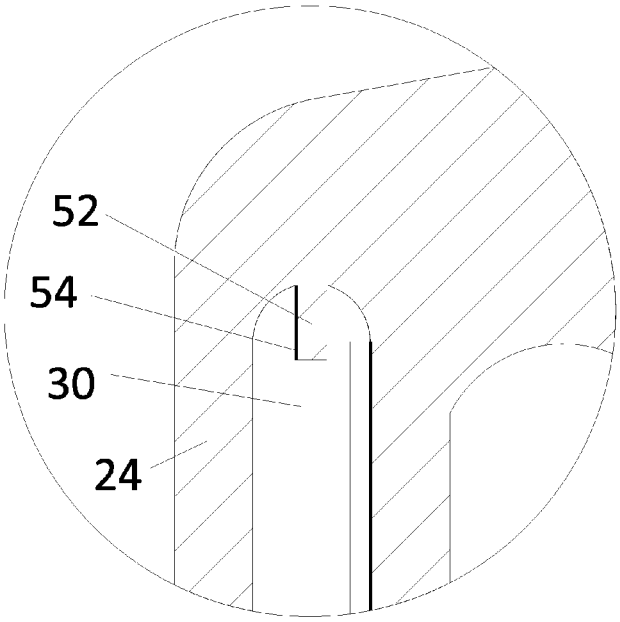

FIG. 14B shows an enlarged view of the proximal portion of the base 24. A tongue 52 is shown in sectional view extending from the base 24. The tongue 52 is shown inserting into a groove 54 on the proximal end of the shaft 30.

Figure 14C:
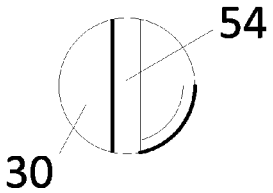
Figure 14D:
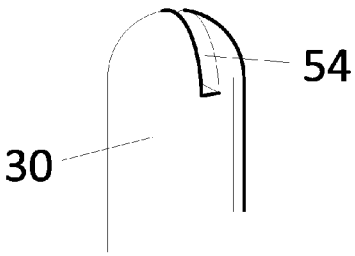

FIGS. 14C and 14D show isolated views of the proximal end of the shaft 30. FIG. 14C shows the groove 54 extending across the diameter of the shaft. FIG. 14D shows an oblique view of the proximal end of the shaft 30 with the groove 54.

The tongue and groove assembly described above can alternatively be constructed with other configurations such as an intersecting pair of blades which mate with an intersecting pair of grooves. This would have an X-shaped configuration.

Operation

FIGS. 14A Through 14D

The tongue and groove is one example of a system for a mechanical attachment which assists in more precisely setting the rotational position of the shaft within the base. This allows the orientation of the club face to be quickly, efficiently, and consistently positioned prior to securing the tightening nut. The tongue and groove orientation can be constructed with a corresponding square or neutral club face position. The tongue and groove orientation can also be constructed to set the club face in any specific meridian. This can be used to provide a preset degree of open or closed face position for fade or draw shots respectively.

The preset orientation of the tongue and groove can also be used to offset any natural deviation of the wrist and forearm. Pronation or supination can be corrected by a corresponding degree of closed or open face position. This allows the wrist and forearm to remain in the natural state of either pronation or supination while having the club face oriented in the desired meridian for proper ball strike.

FIGS. 15A Through 17C

Adjustable Mechanical Embodiments

FIG. 15A through 17C show embodiments of an adjustable mechanical attachment. Calibrated adjustments of the rotational position of the shaft 30 within the base 24 can be made.

Figure 15A:
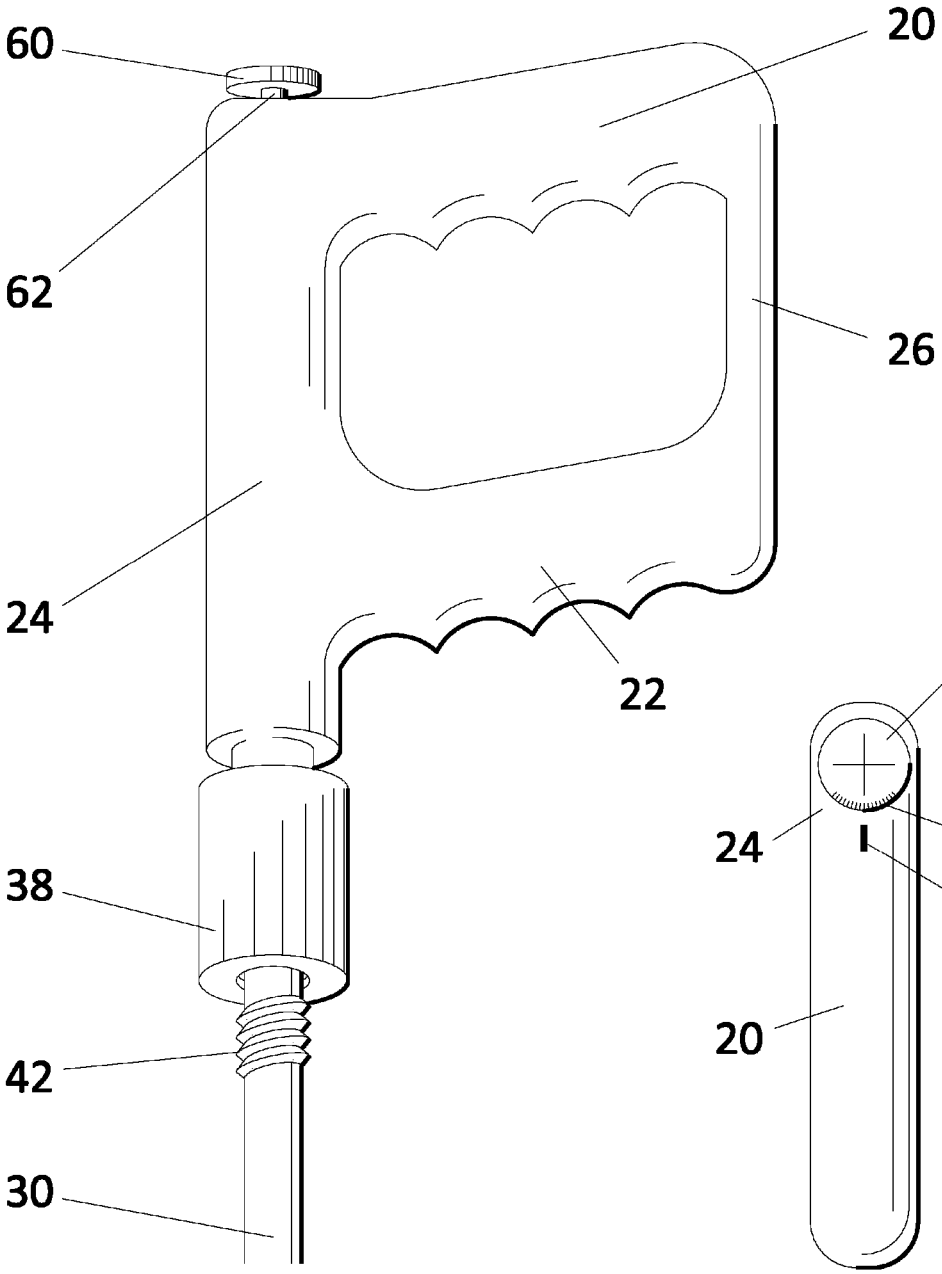
FIGS. 15A and 15B show two views of an adjustable mechanical ergonomic handle in accordance with other embodiments.
Figure 15B:
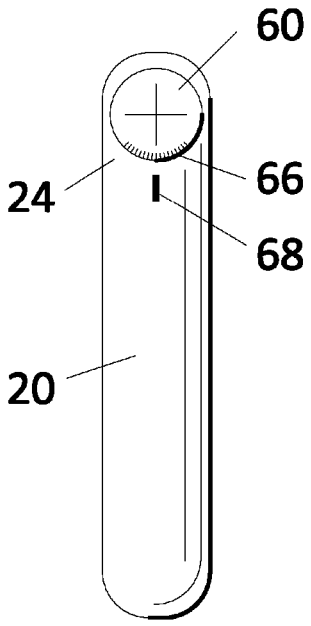

FIG. 15A shows the base 24, proximal handle 20, distal handle 22, bridge 26, tightening nut 38 and shaft 30. The external thread 42 is visible on the shaft 30 because the tightening nut 38 is in the loosened, proximal position. A dial 60 extends from a stem 62 on the proximal end of the base 24. FIG. 15B shows the proximal surface of the base 24 and proximal handle 20. The dial 60 has calibration lines 66. A calibration notch 68 is adjacent to the dial 60 on the proximal end of the base 24. The dial 60 can be turned a specific number of degrees to align a specific calibration line 66 with the calibration notch 68.

Figure 16A:
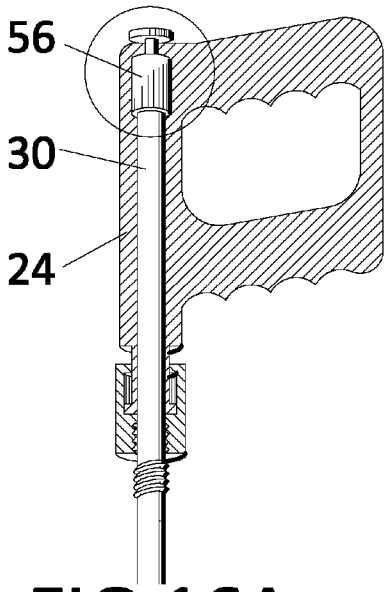
FIGS. 16A to 16C show a sectional view of an adjustable mechanical ergonomic handle with a barrel receptacle and the shaft in place, and isolated views in accordance with other embodiments.
Figure 16B:
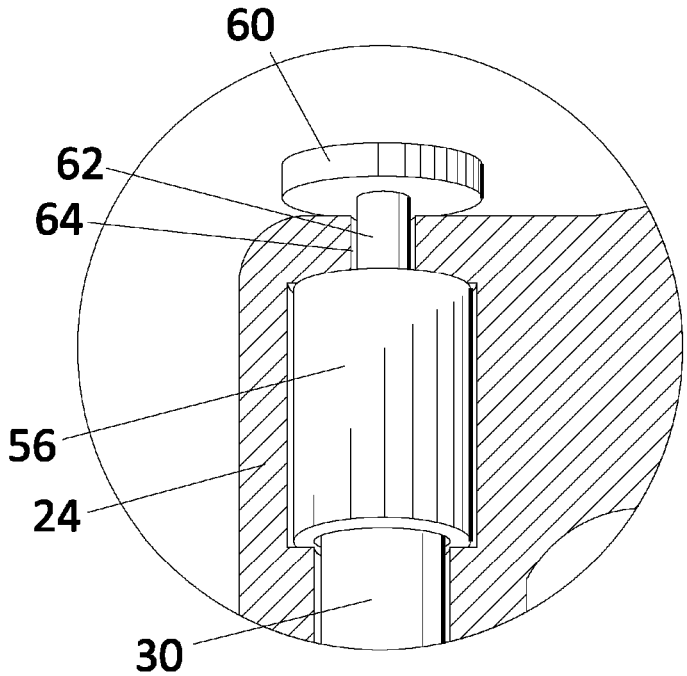
Figure 16C:
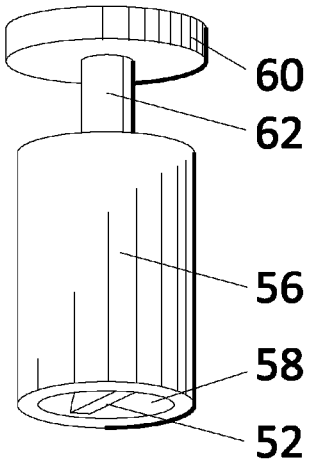

FIG. 16A shows a sectional view of the base 24. The encircled area at the proximal end of the base 24 shows a barrel 56 which receives the proximal end of the shaft 30. FIG. 16B shows an enlarged view of the encircled area at the proximal end of the base 24. The dial 60, stem 62, and barrel 56 are a single unit composed of a rigid material such as steel, graphite, plastic, or metal alloy. This unit is free to be rotated around the axis of the base 24 by turning the dial 60. The stem 62 extends through an aperture 64 in the proximal end of the base 24. The proximal end of the shaft 30 is inserted through the base 24 and into the distal end of the barrel 56. FIG. 16C shows an isolated view of the dial 60, stem 62, and barrel 56. The distal end of the barrel 56 has an opening into a barrel chamber 58. A tongue 52 is shown within the barrel chamber 58. The tongue 52 extends from the proximal end of the barrel chamber 58.

Figure 17A:
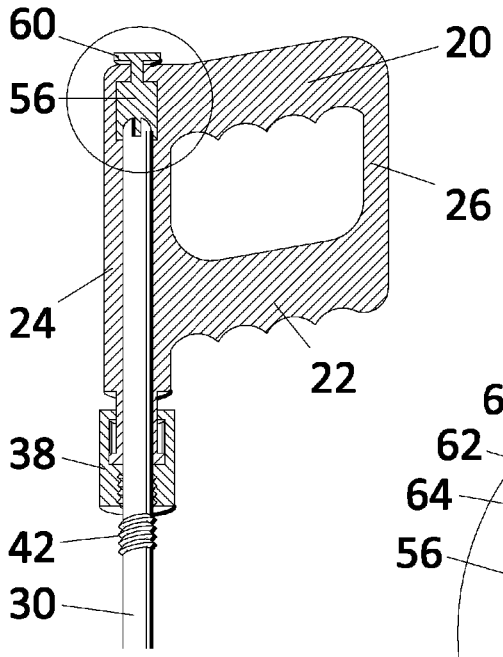
FIGS. 17A to 17C show a sectional view of an adjustable mechanical ergonomic handle, barrel receptacle, stem, and dial with the shaft in place, and isolated views in accordance with other embodiments.
Figure 17B:
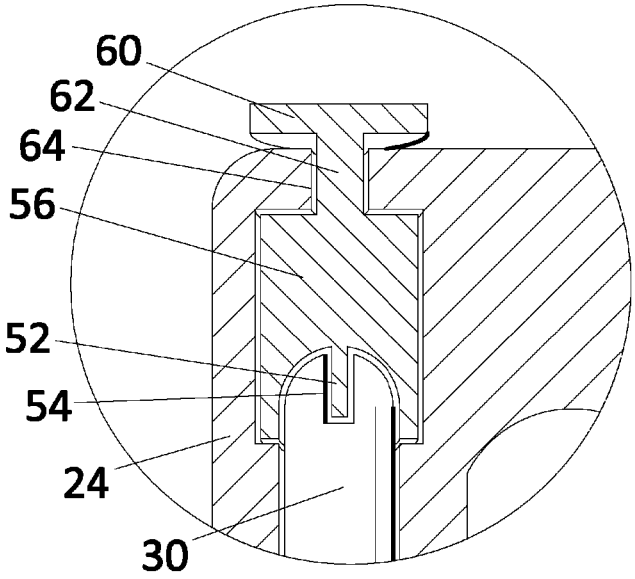
Figure 17C:
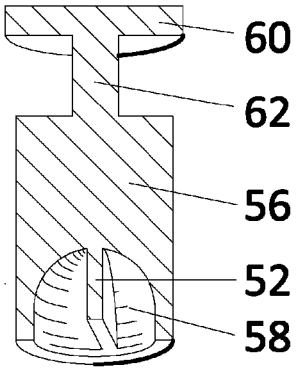

FIG. 17A shows a sectional view of the base 24, proximal handle 20, distal handle 22, bridge 24, tightening nut 38, barrel 56, and dial 60. The shaft 30 is positioned within the base 24. The proximal end of the shaft 30 extends into the barrel 56. Threads 42 are shown on the shaft 30 below the level of the tightening nut 38 because the tightening nut is in the loosened position. The proximal end of the base 24 with barrel 56 and dial 60 are encircled. FIG. 17B shows an enlarged view of the encircled area from FIG. 17A. A sectional view of the dial 60, stem 62, and barrel 56 is shown within the base 24. The stem 62 extends through an aperture 64 in the proximal end of the base 24. The shaft 30 is inserted through the base 24 and into the distal end of the barrel 56. A sectional view of the tongue 52 is shown extending into the groove 54 on the proximal end of the shaft 30. The dial 60, stem 62, and barrel 56 are a single unit which is capable of being rotated within the base 24 by turning the dial 60. When the shaft 30 is in place as shown it assumes a rotational position which corresponds to the rotational position of the barrel 56. FIG. 17C shows an isolated sectional view of the dial 60, stem 62, and barrel 56. This shows a sectional view of the tongue 52 extending from the proximal aspect of the barrel chamber 58.

The tongue and groove assembly described above can alternatively be constructed with other configurations such as an intersecting pair of blades which mate with an intersecting pair of grooves as described above.

Operation

FIGS. 15A Through 17C

The adjustable mechanical attachment allows the rotational orientation of the club face to be positioned by setting the position of the adjustment dial prior to securing the tightening nut. This allows accurate adjustment of the club face in a specific open or closed position. The club face can be set for fade or draw shots respectively. It can also be set to correct for unintended pronation or supination of the wrist and forearm. These adjustments can be made relatively quickly and easily on the golf course as needed.

Advantages

From the description above, a number of advantages of some embodiments of the ergonomic handle golf club become evident:

(a) Each handle can be grasped firmly and comfortably because the angle of the handle is in an axis which is in substantial ergonomic alignment with the grasp of the hand.
(b) The swing is characterized by a single center of rotation of the preferred hand and arm around one shoulder.
(c) A shaft angle of 180 degrees is possible. Address of the ball is therefore simplified.
(d) The swing plane of the golf club is substantially aligned with the swing plane of the preferred arm.
(e) The wrist position is substantially neutral when the ball is struck. This avoids excessive ulnar wrist flexion.
(f) The preferred hand and arm is used to grasp the proximal handle for primary power and control of the swing of the club.
(g) A distal handle grip is available for the non-preferred hand to assist with control and power of the swing. This allows firm and comfortable grasp with substantially neutral wrist position.
(h) Both hands can be aligned along the axis of the club. This allows coordinated use of similar muscle groups in each hand and arm.
(i) Visual feedback is improved.
(j) Proprioceptive and kinesthetic feedback is improved.
(k) An unobstructed line of sight from the arm of the golfer to the club shaft is provided.
(l) Wrist and forearm rotation around the axis of the shaft during the swing is reduced. This reduces unintentional open or closed club face position. Ball strike is more accurate.
(m) Grasp of the non-preferred hand can be released during the swing because the grasp of the preferred hand on the proximal handle is stable. Release of the grasp of the non-preferred hand during the swing reduces resistance on the follow-through of the preferred hand.
(n) The ergonomic handle is constructed without a cumbersome apparatus. It is therefore comfortable and relatively uncomplicated to use.

(o) Swing of the preferred arm is directed toward abduction. This results in reduced torque force on the shoulders, spine, hips, and knees.

(p) Mechanical attachments are available to secure the shaft to the base. This allows interchangeability of shafts, adjustments of club length, and adjustments of club face orientation. These features are helpful for storage of clubs, modification of clubs for various conditions of the golf course, and modification of clubs for the individual needs of the golfer.

CONCLUSIONS, RAMIFICATIONS, AND SCOPE

Accordingly, the ergonomic handle golf club can be securely and comfortably grasped. The preferred arm has primary control of the swing including control of the swing plane and power of the swing. The non-preferred arm provides assistance with control and power of the swing without restricting the preferred arm. Furthermore, the ergonomic handle golf club has the additional advantages that:

The wrists are in substantially neutral position when the ball is struck. This improves comfort and security of grasp.

The shaft angle is reduced or eliminated. This improves accuracy and consistency with address of the ball.

The swing plane of the club and arms are substantially aligned. This simplifies the swing technique.

The club and preferred arm have a substantially single center of rotation at one shoulder.

Rotation of the forearms, wrists, and club around the axis of the shaft is minimized. This improves accuracy of club face position for ball strike.

Handles are available in a plurality of arrangements and shapes. This allows custom fitting for the individual needs and preferences of the golfer.

Club face positions are available in a plurality of orientations around the axis of the shaft in relation to the positions of the handles. This corrects for misalignment of wrist and forearm position in pronation or supination. It also allows club design for draw or fade shots of a predetermined degree.

Primary control of the swing is based on hand preference. This is influenced by hand dominance as well as other individual variables and preferences. Club heads are constructed with right or left directed face position based on the individual choice of preferred hand.

Backhand or abduction swing of the preferred arm has greater capacity for comfortable follow-through.

The secondary arm can be used to assist with power and control through any desired portion of the swing. This affords the golfer a plurality of swing technique options. The choice is based on factors such as the type of club head, conditions of the terrain, intended distance of the shot, and individual preference of the golfer.

A more vertically oriented shaft angle is possible. This allows a more simplified pendulum style swing motion and a more stable club face position.

Mechanical attachments allow quick, simple interchange of shafts with handles as needed for conditions on the course. This allows interchange of different clubs such as the driver, wood, hybrid, iron, wedge, or putter with the handles. It also allows changes in golf club length. Additionally, it reduces the weight of the set of golf clubs.

Mechanical attachments allow adjustments to be made in the rotational orientation of the face position for individual golfer needs or preferences. This will also allow a specific orientation of the face position to be set for draw or fade shots as needed.

Torque force on the on the shoulders, spine, hips, and knees is reduced. This enables individuals with arthritis and other disabling conditions to participate.

Single hand technique is possible. This allows individuals with an impairment of one upper extremity to participate.

The ergonomic handle golf club is appropriate for the driver, wood, hybrid, iron, wedge, putter or any other type of club.

Although the description above contains many specificities, these should not be construed as limiting the scope of the embodiments but as merely providing illustrations of some of several embodiments. For example, the base and handles can have other shapes, dimensions, and interrelationships as needed for the individual fit and preferences of the golfer. Other types of mechanical attachments can be used.

Thus the scope of the embodiments should be determined by the appended claims and their legal equivalents, rather than by the examples given.

I claim:

1. A golf club of the type comprising a shaft with a head on one end and a grip on the other end, the improvement wherein said grip is an elongated substantially cylindrical base oriented in substantially the same axis as said shaft, with a proximal handle and a distal handle relative to the distance from a golfer along the axis of said base, each of which extends directly from said base, and means for joining said base to said shaft.

2. The golf club of claim 1 wherein said proximal handle and said distal handle each extend at an angle from said base and in a meridian which is substantially opposite the head whereby said handles can be securely and comfortably grasped with each hand positioned substantially adjacent to said base.

3. The golf club of claim 1 wherein said proximal handle and said distal handle each extend from a respective location on said base and each have a respective orientation in relation to both the vertical and horizontal planes such that they are oriented substantially perpendicular to the axis of said base and said shaft.

4. The golf club of claim 1 wherein said proximal handle and said distal handle are connected together by a bridge substantially at the opposite end from said base.

5. The golf club of claim 1 wherein said proximal handle or said distal handle are attached by a bridge or bridges to said base.

6. The golf club of claim 1 wherein first said means for joining said shaft to said base is a durable bond to provide a fixed relationship between the radial orientation of said handles and the radial orientation of said head.

7. The golf club of claim 1 wherein second said means for joining said shaft to said base is a removable mechanical attachment to provide an adjustable relationship between the radial orientation of said handles and the radial orientation of said head.

8. The golf club of claim 7 wherein said removable mechanical attachment has means for adjusting the orientation of said shaft with greater precision within said base.

9. A golf club of the type comprising a shaft with a head on one end and a grip on the other end, characterized in that said grip is an elongated substantially cylindrical base oriented in substantially the same axis as said shaft, with a proximal handle and a distal handle relative to the distance from a golfer along the axis of said base, extending directly from said base, and means for securely joining said base to said shaft.

10. The golf club of claim 9 wherein said proximal handled and said distal handle each extend at an angle from the axis of said base and in a meridian which is substantially opposite the head whereby each said handle can be securely and comfortably grasped by a hand with each hand positioned substantially adjacent to said base.

11. The golf club of claim 9 wherein said proximal handle and said distal handle have a specified spacing and specified orientation relative to said base such that they are oriented substantially perpendicular the axis of said base and said shaft.

12. The golf club of claim 9 wherein said proximal handle and said distal handle are connected together by a bridge attached opposite from said base.

13. The golf club of claim 9 wherein said proximal handle or said distal handle are attached by a bridge or bridges to said base.

14. The golf club of claim 9 wherein first said means for joining said shaft to said base is durable bonding to provide a fixed relationship between the radial orientation of said handles and the radial orientation of said head.

15. The golf club of claim 9 wherein second said means for joining said shaft to said base is a removable mechanical attachment to provide an adjustable relationship between the radial orientation of said handles and the radial orientation of said head.

16. The golf club of claim 15 wherein said removable mechanical attachment has adjustable means for calibrating the orientation of said shaft with greater precision.

17. A method of a swinging a golf club, comprising:

a) Providing a golf club of the type comprising a shaft with a head on one end and a base on the other end, wherein said base has an elongated substantially cylindrical shape and is oriented in substantially the same axis as said shaft, and having a proximal handle and a distal handle relative to the distance from a golfer along the axis of said base, each oriented substantially perpendicular to the axis of said base and said shaft, with optional bridge or bridges connecting said handles and said base, and means for joining said base to said shaft in a secure manner to provide a stable relationship between the radial orientation of said handles and the radial orientation of said head;

b) Grasping said proximal handle closest to said golfer with a dominant or preferred hand and arm while addressing a golf ball from the same side as the dominant hand;

c) Grasping said distal handle farthest from said golfer, or said base if desired with a non-dominant or non-preferred hand and arm;

d) Drawing said club back in preparation for a swing by adducting said preferred hand and arm while abducting said non-preferred hand and arm;

e) Swinging said club forward in the intended direction of swing by abducting said preferred hand and arm while adducting said non-preferred hand and arm;

f) Releasing grasp of said distal handle or said base at any desired point during said swing while maintaining grasp of said proximal handle throughout said swing;

Whereby said golf club can be grasped in a secure and comfortable manner using the preferred hand for primary control of the swing and the non-preferred hand for assistance thus providing simplified mechanics with less restriction of said swing and substantially reversed swing direction.

18. The method of claim 17 wherein said base, said proximal handle, said distal handle, and said bridge or bridges are composed of a strong material such as metal alloy, graphite, or steel to support precise calibration and unique forces on the club.

* * * * *